US012584406B2

(12) United States Patent
Schouten et al.

(10) Patent No.: US 12,584,406 B2
(45) Date of Patent: Mar. 24, 2026

(54) SYSTEM AND METHOD FOR IMAGING SUBSURFACE DENSITY USING COSMIC RAY MUONS

(71) Applicant: Ideon Technologies Inc., Richmond (CA)

(72) Inventors: Douglas William Schouten, Surrey (CA); Benjamin Christopher Barbour, Vancouver (CA)

(73) Assignee: Ideon Technologies Inc., Richmond (CA)

( * ) Notice: Subject to any disclaimer, the term of this patent is extended or adjusted under 35 U.S.C. 154(b) by 0 days.

(21) Appl. No.: 18/922,319

(22) Filed: Oct. 21, 2024

(65) Prior Publication Data

US 2025/0052149 A1 Feb. 13, 2025

Related U.S. Application Data

(63) Continuation of application No. PCT/CA2023/050548, filed on Apr. 21, 2023.

(60) Provisional application No. 63/333,955, filed on Apr. 22, 2022.

(51) Int. Cl.
*E21B 49/00* (2006.01)
*E21B 17/042* (2006.01)

(52) U.S. Cl.
CPC ..... *E21B 49/00* (2013.01); *E21B 17/042* (2013.01)

(58) Field of Classification Search
CPC ..... E21B 49/00; E21B 17/042
See application file for complete search history.

(56) References Cited

U.S. PATENT DOCUMENTS

| | | | | |
|---|---|---|---|---|
| 1,526,361 | A * | 2/1925 | Much | E21B 31/18 294/86.31 |
| 2,968,728 | A | 1/1961 | Eberline | |
| 4,904,865 | A * | 2/1990 | Meisner | G01V 5/101 250/254 |
| 5,184,692 | A * | 2/1993 | Moriarty | G01V 5/08 175/50 |
| 6,044,326 | A | 3/2000 | Huiszoon | |
| 6,047,784 | A * | 4/2000 | Dorel | E21B 7/068 175/73 |
| 6,057,784 | A | 5/2000 | Schaaf et al. | |
| 6,705,415 | B1 * | 3/2004 | Falvey | E21B 17/046 175/320 |

(Continued)

FOREIGN PATENT DOCUMENTS

| | | | |
|---|---|---|---|
| CA | 2472674 | C | 7/2008 |
| CN | 112814638 | A * | 5/2021 |

(Continued)

*Primary Examiner* — Aaron L Lembo
(74) *Attorney, Agent, or Firm* — Todd A. Rattray; Oyen Wiggs Green & Mutala LLP

(57) ABSTRACT

A longitudinally extending detector drill rod is connectable at each of its longitudinal ends to another drill rod in a drill string and is deployable, as part of the drill string, to a location below a surface of the earth for detecting cosmic ray muons that penetrate the surface of the earth. The detector drill rod comprises: a drill rod bore-defining surface that defines a longitudinally extending drill rod bore; and one or more muon sensors located in the drill rod bore, the one or more muon sensors responsive to muons interacting therewith.

20 Claims, 21 Drawing Sheets

(56) References Cited

U.S. PATENT DOCUMENTS

| | | | | |
|---|---|---|---|---|
| 7,073,378 | B2 * | 7/2006 | Smits | G01V 5/12 73/152.14 |
| 7,178,391 | B2 * | 2/2007 | Casper | E21B 49/00 73/152.05 |
| 7,488,934 | B2 * | 2/2009 | Bryman | G01V 5/08 250/266 |
| 7,863,571 | B2 * | 1/2011 | Beken | G01T 1/185 250/382 |
| 8,760,657 | B2 * | 6/2014 | Pope | E21B 47/113 250/269.1 |
| 9,329,303 | B2 * | 5/2016 | Inanc | G01V 5/107 |
| 9,939,549 | B2 * | 4/2018 | Miles | G01V 5/00 |
| 10,578,763 | B2 * | 3/2020 | Gabelmann | E21B 17/1021 |
| 10,941,651 | B2 * | 3/2021 | Pan | E21B 47/13 |
| 10,962,485 | B2 * | 3/2021 | Scoullar | E21B 49/005 |
| 11,492,853 | B2 * | 11/2022 | Steinhoff | F16L 15/003 |
| 11,892,463 | B2 * | 2/2024 | Holma | G01N 9/24 |
| 11,971,373 | B2 * | 4/2024 | Botto | G01N 9/24 |
| 12,007,527 | B2 * | 6/2024 | Schouten | G01T 1/18 |
| 2004/0083835 | A1 * | 5/2004 | Casper | E21B 17/042 73/866.5 |
| 2004/0242044 | A1 * | 12/2004 | Head | E21B 17/0285 439/190 |
| 2005/0011290 | A1 * | 1/2005 | Casper | E21B 17/042 73/866.5 |
| 2006/0032629 | A1 * | 2/2006 | Casper | E21B 17/042 166/250.01 |
| 2007/0120364 | A1 * | 5/2007 | Casper | F16L 15/008 285/333 |
| 2007/0272444 | A1 * | 11/2007 | Carlson | E21B 17/18 175/320 |
| 2017/0138132 | A1 * | 5/2017 | Wilson | E21B 49/00 |
| 2017/0335674 | A1 | 11/2017 | Laban | |
| 2018/0203154 | A1 * | 7/2018 | Gabelmann | G01V 3/34 |
| 2024/0213009 | A1 * | 6/2024 | Malowney | G01T 1/18 |

FOREIGN PATENT DOCUMENTS

| | | | | |
|---|---|---|---|---|
| CN | 113550707 | A | * | 10/2021 |
| GB | 2548101 | A | | 9/2017 |
| WO | 2014127452 | A1 | | 8/2014 |
| WO | 2020186338 | A1 | | 9/2020 |
| WO | 2020237369 | A1 | | 12/2020 |

* cited by examiner

NOT DRAWN TO SCALE

SYSTEM AND METHOD FOR IMAGING SUBSURFACE DENSITY USING COSMIC RAY MUONS

CROSS-REFERENCE TO RELATED APPLICATIONS

This application is a continuation of Patent Cooperation Treaty (PCT) application No. PCT/CA2023/050548 entitled SYSTEM AND METHOD FOR IMAGING SUBSURFACE DENSITY USING COSMIC RAY MUONS and having an international filing date of 21 Apr. 2023, which in turn claims priority from, and for the purposes of the United States claims the benefit under 35 USC 119 in connection with, U.S. application No. 63/333,955 filed 22 Apr. 2022 and entitled SYSTEM AND METHOD FOR IMAGING SUBSURFACE DENSITY USING COSMIC RAY MUONS. All of the applications referred to in this paragraph are hereby incorporated herein by reference for all purposes.

FIELD

This technology relates to systems and methods for imaging subsurface density using cosmic ray muons, and, in particular, to drill rod(s) (referred to herein as detector drill rod(s)) which house muon detectors and methods of deployment thereof.

BACKGROUND

Exploitation of underground resources (e.g., mineral deposits, oil reservoirs) employs varied geophysical methods to detect, image, and monitor underground regions of interest. Many of the devices and systems used are large.

Muon radiography is a method of detecting, imaging and/or monitoring underground regions of interest by measuring the attenuation of muon intensity underground. Muon detectors positioned below a region of interest, such as a desired subsurface formation, can measure a directional intensity of muons propagating through the overburden. The directional intensity of muons relates directly to the average density of matter along a straight-line path in the direction of measurement. By situating muon detectors in different locations, 2D radiographic images can be developed from multiple views of the region of interest. These 2D images can be combined using tomographic algorithms to develop 3D models of subsurface density in process(es) known as muon tomography.

In some cases, accessing desired underground locations (e.g. below region(s) of interest) to install muon detectors in such locations is difficult and/or impractical. For example, a desired underground location may only be accessible through a relatively narrow cross-section (e.g. about 70 mm to about 100 mm) borehole drilled by a drill string, such that it is impractical to enter the borehole to install the muon sensors.

FIG. 1 is a schematic side view of a drill rod coupling 10 of two drill rods 1, 2 in accordance with standard prior art practice. Drill rods 1, 2 are typically tubulars elongated in an axial direction and shaped to define axially extending bores therethrough for permitting travel of material (e.g. drilling fluid, rock cuttings) through their bores. Drill rod 1 comprises a tubular body 3 and a male end connector 5 on one end of tubular body 3. Drill rod 2 comprises a tubular body 4 and a female end connector 6 on one end of tubular body 4. Drill rod 1 is connectable to drill rod 2 through engagement of male end connector 5 of drill rod 1 with female end connector 6 of drill rod 2. In standard drilling practice, a plurality of drill rods (each similar to drill rods 1, 2) may be successively connected together at a surface level drill rig, for example, through the mechanism shown in FIG. 1, to form a drill string. Driving force may be transmitted from the surface level drill rig, through the drill string to a drill bit at a downhole end of the drill string to facilitate drilling deep drill boreholes. For example, a drill string can include up to hundreds of drill rods. A standard drill rod is approximately 3 meters in length, although other lengths are also used.

In standard practice, a drill string may be driven by a surface level drill rig to transmit force to a downhole drill bit and to thereby penetrate into the earth and drill a borehole. FIG. 2 is a schematic side view of an example of a conventional mobile drill rig 20 operable to form and drive a drill string into the earth for making a drill borehole. Drill rig 20 can push and rotate a drill string downhole along arbitrary angles. As the drill string penetrates further downhole, successive drill rods may be added to the drill string at surface level. A drill string may also be extracted from a borehole by successively detaching drill rods at surface level.

The ability to deploy muon detectors inside exploration drill boreholes is desirable for achieving multiple views of a region of interest from different locations and depths and to thereby facilitate development of accurate models of density. Examples of muon detectors that can be deployed in exploration boreholes include those described in Patent Cooperation Treaty applications No. PCT/CA2020/050716 (published under WO2020/237369) and PCT/CA2020/000036 (published under WO2020/186338), both of which are hereby incorporated herein by reference.

There are significant challenges to deploying muon sensors in drill boreholes. Such challenges include, without limitation, (a) muon detectors can become stuck in a borehole due to ingress of debris that may wedge between the muon detector and the wall of the borehole; (b) the wall of the borehole may partially or fully collapse and block the passageway for deploying or retrieving muon sensors; (c) boreholes are narrow (in some cases less than 10 cm in diameter) so the muon detectors need to have small aperture; (d) downhole power and communications need to be provided over hundreds of meters of cable span; (e) it is desirable that the muon detectors be relatively inexpensive to be economically viable as a geophysical tool; (f) in some cases, partial or full blockage due to debris, drill rod grease or other contaminants, may even prohibit installation of the detector to begin with.

There is a general desire for an inexpensive muon detector system that provides high resolution for determining the direction of the muons that pass through the detector, while at the same time having a narrow cross-sectional dimension suitable for deployment down standard drill boreholes of various quality, and being sufficiently resilient to withstand partial or full borehole collapse as well as to be moved through boreholes and scraped past debris during both deployment and removal.

SUMMARY

One aspect of the invention provides a longitudinally extending detector drill rod connectable at each of its longitudinal ends to another drill rod in a drill string and deployable, as part of the drill string, to a location below a surface of the earth for detecting cosmic ray muons that penetrate the surface of the earth. The detector drill rod comprises a drill rod bore-defining surface that defines a longitudinally extending drill rod bore and one or more muon sensors located in the drill rod bore, the one or more muon sensors responsive to muons interacting therewith.

The detector drill rod may comprise a fluid flow passage located in the drill rod bore for permitting fluid flow from a first longitudinal end of the drill rod bore to a second longitudinal end of the drill rod bore, the second longitudinal end opposed to the first longitudinal end. One or more muon sensors may be located outside of the fluid flow passage. The fluid flow passages may comprise a longitudinally extending conduit, the conduit comprising a conduit bore-defining surface that defines a longitudinally extending conduit bore for permitting fluid flow therethrough.

The conduit may be centrally located in the drill rod bore in cross-sections having sectional planes orthogonal to a longitudinal direction (e.g. the conduit is symmetric about a longitudinally extending central axis of the drill rod bore). One or more muon sensors may be mounted to the conduit and located on an exterior of the conduit.

The detector drill rod may comprise a first seal located relatively close to the first longitudinal end of the drill rod bore. The first seal may be sealed to, or integrally formed with, the drill rod bore defining surface and the first seal may be sealed to, or integrally formed with, the conduit. The detector drill rod may comprise a second seal located relatively close to the second end of the drill rod bore. The second seal may be sealed to the drill rod bore defining surface and the second seal may be sealed to, or integrally formed with, the conduit.

The seals and/or integral formation of the first and second seals may provide a fluid-impermeable region that is in the drill rod bore, between longitudinal locations of the first and second seals and exterior to the conduit. One or more muon sensors may be located in the fluid-impermeable region while permitting fluid flow through the conduit bore between a longitudinal side of the second seal opposite the first seal location and a longitudinal side of the first seal opposite the second seal location.

The first seal may be welded to the drill rod bore-defining surface. The first seal may be sealed to the drill rod bore-defining surface by one or more ring seals disposed between the first seal and the drill rod-bore defining surface. One or more ring seals may be disposed around a circumferential facing surface of the first seal.

One or more ring seals may be disposed between a longitudinal facing surface of the first seal and a longitudinal face of a shoulder of the drill rod bore-defining surface, where a cross-sectional dimension of the drill rod bore changes.

The first seal may comprise a connector component and the conduit comprises a complementary connector component and the first seal is sealed to the conduit by a connection formed between the connector component and the complementary connector component. The connector component and the complementary connector component may comprise threaded connector components. The first seal may be integrally formed with or welded to the conduit.

The first seal may be shaped to define a hole extending longitudinally therethrough. The first seal may be located at the first seal location such a portion of the conduit extends into the hole. The detector drill rod may comprise a sealing plug that is insertable into the hole to seal the first seal to the conduit.

The second seal may be sealed to the drill rod bore-defining surface by one or more ring seals disposed between the second seal and the drill rod-bore defining surface. The one or more ring seals are disposed around a circumferential facing surface of the second seal. The one or more ring seals may be disposed between a longitudinal facing surface of the second seal and one of: a longitudinal facing surface of a threaded insert; and a longitudinal facing surface of an adjacent drill rod in the drill string.

The second seal may comprise a connector component and the conduit may comprise a complementary connector component and the second seal may be sealed to the conduit by a connection formed between the connector component and the complementary connector component. The connector component and the complementary connector component may comprise threaded connector components. The second seal may be integrally formed with or welded to the conduit.

The second seal may be shaped to define a hole extending longitudinally therethrough. The second seal may be located at the second seal location such a portion of the conduit extends into the hole. The detector drill rod may comprise a sealing plug that is insertable into the hole to seal the second seal to the conduit. The second seal may be removably sealed to the drill rod bore-defining surface to permit insertion and removal of the second seal from the detector drill rod.

The first seal may comprise a first feedthrough hole extending longitudinally therethrough and a first feedthrough plug configured to extend into and seal the first feedthrough hole in a fluid impermeable manner while permitting a first electrical connection between a first longitudinal side of the first seal and a second longitudinal side of the first seal opposite the first longitudinal side of the first seal.

The first electrical connection may comprise an extension of one or more electrical cables through the first feedthrough hole. The first electrical connection may comprise a connection of one more cables to an electrical connector at at least one of the first longitudinal side of the first seal and the second longitudinal side of the first seal.

The second seal may comprise a feedthrough hole extending longitudinally therethrough and a second feedthrough plug configured to extend into and seal the second feedthrough hole in a fluid impermeable manner while permitting a second electrical connection between a first longitudinal side of the second seal and a second longitudinal side of the second seal opposite the first longitudinal side of the second seal.

The second electrical connection may comprise an extension of one or more electrical cables through the second feedthrough hole. The second electrical connection may comprise a connection of one more cables to an electrical connector at at least one of the first longitudinal side of the second seal and the second longitudinal side of the second seal.

One or more muon sensors may be located in a fluid-impermeable housing. The housing may have cross-sectional dimensions (e.g. area) in sectional planes orthogonal to a longitudinal direction that is less than cross-sectional dimensions (e.g. area) of the drill rod bore in the same sectional planes to thereby provide the fluid flow passage between an exterior surface of the housing and the drill rod bore-defining surface.

The detector drill rod may comprise a support bracket extending from the exterior surface of the housing to the drill rod bore-defining surface for supporting the housing. The support bracket may be shaped to define one or more longitudinal apertures therethrough to provide the fluid flow passage between a first longitudinal side of the support bracket and a second longitudinal side of the support bracket opposite to the first longitudinal side of the support bracket.

The detector drill rod may comprise a second support bracket extending from the exterior surface of the housing to the drill rod bore-defining surface for supporting the housing. The second support bracket may be spaced longitudinally apart from the support bracket. The second support bracket may be shaped to define one or more second longitudinal apertures therethrough to provide the fluid flow passage between a first longitudinal side of the second support bracket and a second longitudinal side of the second support bracket opposite to the first longitudinal side of the second support bracket.

The support bracket may abut against a longitudinal face of a shoulder of the drill rod bore-defining surface, where a cross-sectional dimension of the drill rod bore changes.

The support bracket may abut against a longitudinal face of a shoulder of the drill rod bore-defining surface, where a cross-sectional dimension of the drill rod bore changes, and the second support bracket may abut against at least one of: a longitudinal facing surface of a threaded insert; and a longitudinal facing surface of an adjacent drill rod in the drill string.

Another aspect of the invention provides a method for detecting cosmic ray muons that penetrate a surface or the earth. The method comprises: (i) locating one or more muon sensors in a drill rod bore of a detector drill rod; (ii) connecting the detector drill rod to one or more other drill rods to provide a drill string; and (iii) inserting at least a portion of the drill string including the detector drill rod below the surface of the earth.

The method may comprise, prior to performing steps (ii) and (iii), drilling a borehole with a second drill string that does not include the detector drill rod and extracting at least a portion of the second drill string from the borehole.

Inserting at least a portion of the drill string including the detector drill rod below the surface of the earth may comprise drilling through the earth in the borehole with the drill string that includes the detector drill rod.

Inserting at least a portion of the drill string including the detector drill rod below the surface of the earth may comprise drilling through the earth with the drill string that includes the detector drill rod.

The method may comprise inserting a cable barrel into a bore of the drill string. The cable barrel may comprise pre-spooled cable wherein the pre-spooled cable of the cable barrel is connected to the detector drill rod prior to step (iii). The method may comprise inserting an overshot tool into the bore of the drill string after step (iii), the overshot tool connectable to the cable barrel.

The method may comprise connecting the overshot tool to the cable barrel when the cable barrel is located downhole and retrieving the cable barrel through the bore of the drill string by pulling the overshot tool in an uphole direction. Pulling the overshot tool in the uphole direction may comprise un-spooling the pre-spooled cable from the cable barrel.

Locating one or more muon sensors in the drill rod bore of the detector drill rod may comprise inserting a muon detector assembly comprising the one or more muon sensors into the drill rod bore through one of first and second longitudinally opposed ends of the detector drill rod and securing a longitudinal location of the muon detector assembly in the drill rod bore with one or more securing components inserted into the drill rod bore through the one of the first and second ends of the detector drill rod. Securing components may comprise one of more of: a seal; a threaded insert; and a longitudinal facing surface of an adjacent drill rod in the drill string.

Inserting a muon detector assembly comprising the one or more muon sensors into the drill rod bore through the one of first and second longitudinally opposed ends of the detector drill rod may comprise mounting the detector assembly on a conduit and inserting the conduit into the drill rod bore through the one of the first and second ends. The conduit may be shaped to define a conduit bore which provides at least a portion of a fluid flow passage for permitting fluid flow between the first and second ends.

Inserting a muon detector assembly comprising the one or more muon sensors into the drill rod bore through the one of first and second longitudinally opposed ends of the detector drill rod may comprise housing the one or more muon sensors in a fluid-impermeable housing, providing one or more apertured brackets integrally formed with or rigidly connected to an exterior of the housing, and inserting a combination of the housing and the one or more brackets into the drill rod bore through the one of the first and second ends.

The one or more apertured brackets may be shaped to provide one or more apertures which provide at least a portion of a fluid flow passage for permitting fluid flow between the first and second ends.

Securing the longitudinal location of the muon detector assembly in the drill rod bore may comprise making use of any of the features, combinations of features and/or sub-combinations of features of any of the detector drill rods as disclosed herein or any of the features, combinations of features and/or sub-combinations of features otherwise described herein.

Locating one or more muon sensors in the drill rod bore of the detector drill rod may comprise providing fluid flow passage between the first and second ends. Locating one or more muon sensors in the drill rod bore of the detector drill rod may comprise locating the one or more muon sensors outside of the fluid flow passage. Locating the one or more muon sensors outside of the fluid flow passage may comprise sealing the fluid flow passage from a region of the drill rod bore where the one or more muon sensors are located.

Sealing the fluid flow passage from a region of the drill rod bore where the one or more muon sensors are located may comprise making use of any of the features, combinations of features and/or sub-combinations of features of any of the detector drill rods disclosed herein or any of the features, combinations of features and/or sub-combinations of features otherwise described herein.

Another aspect of the invention provides a method for assembling a longitudinally extending detector drill rod for deployment in a drill string to a location below a surface of the earth for detecting cosmic ray muons that penetrate the surface of the earth. The method may comprise: (i) providing a longitudinally extending detector drill rod having first and second longitudinally spaced apart ends, the detector drill rod comprising a drill rod bore-defining surface that defines a longitudinally extending drill rod bore; (ii) inserting a muon detector assembly comprising one or more muon sensors into the drill rod bore through one of the first and second ends of the detector drill rod; (iii) securing a longitudinal location of the muon detector assembly in the drill rod bore with one or more securing components inserted into the drill rod bore through the one of the first and second ends of the detector drill rod.

Securing components may comprise one of more of: a seal; a threaded insert; and a longitudinal facing surface of an adjacent drill rod in the drill string.

Inserting the muon detector assembly into the drill rod bore through the one of the first and second ends may comprise mounting the detector assembly on a conduit and inserting the conduit into the drill rod bore through the one of the first and second ends.

The conduit may be shaped to define a conduit bore which provides at least a portion of a fluid flow passage for permitting fluid flow between the first and second ends.

Inserting the muon detector assembly into the drill rod bore through the one of the first and second ends may comprise housing the one or more muon sensors in a fluid-impermeable housing; providing one or more apertured brackets integrally formed with or rigidly connected to an exterior of the housing and inserting a combination of the housing and the one or more brackets into the drill rod bore through the one of the first and second ends.

The one or more apertured brackets may be shaped to provide one or more apertures which provide at least a portion of a fluid flow passage for permitting fluid flow between the first and second ends.

Securing the longitudinal location of the muon detector assembly in the drill rod bore may comprise making use of any of the features, combinations of features and/or sub-combinations of features of any of the detector drill rods disclosed herein or any of the features, combinations of features and/or sub-combinations of features otherwise described herein.

Inserting the muon detector assembly into the drill rod bore through the one of the first and second ends may comprise providing fluid flow passage between the first and second ends. Inserting the muon detector assembly into the drill rod bore through the one of the first and second ends may comprise locating the one or more muon sensors outside of the fluid flow passage.

Locating the one or more muon sensors outside of the fluid flow passage may comprise sealing the fluid flow passage from a region of the drill rod bore where the one or more muon sensors are located.

Sealing the fluid flow passage from a region of the drill rod bore where the one or more muon sensors are located may comprise making use of any of the features, combinations of features and/or sub-combinations of features of any of the detector drill rods disclosed herein or any of the features, combinations of features and/or sub-combinations of features otherwise described herein.

It is emphasized that the invention relates to all combinations of the above features, even if these are recited in different claims.

Further aspects and example embodiments are illustrated in the accompanying drawings and/or described in the following description.

BRIEF DESCRIPTION OF THE DRAWINGS

The accompanying drawings illustrate non-limiting example embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Aspects of the invention provide a longitudinally extending detector drill rod connectable at each of its longitudinal ends to another drill rod in a drill string and deployable, as part of the drill string, to a location below a surface of the earth for detecting cosmic ray muons that penetrate the surface of the earth. The detector drill rod comprises: a drill rod bore-defining surface that defines a longitudinally extending drill rod bore; and one or more muon sensors located in the drill rod bore, the one or more muon sensors responsive to muons interacting therewith.

Detector Drill Rod

Figure 3:
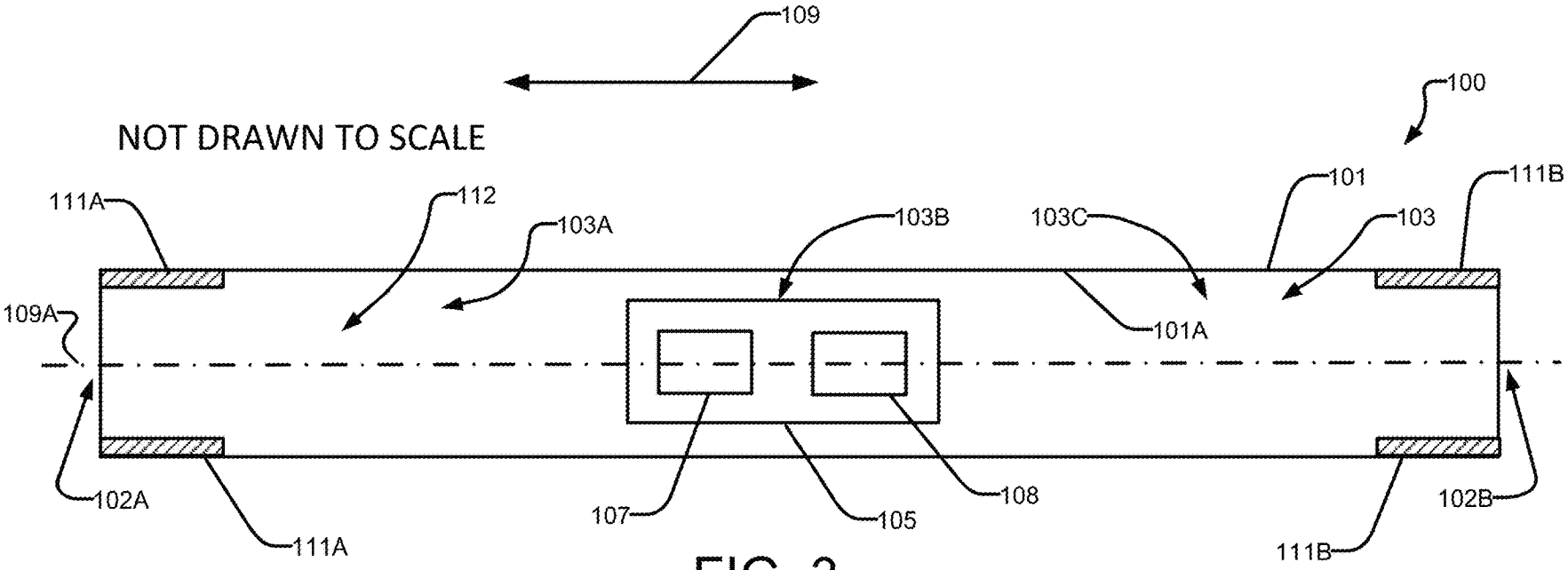
FIG. 3 is a schematic side view of a detector drill rod according to an example embodiment.

FIG. 3 is a schematic side view of a detector drill rod 100 according to an example embodiment. In this disclosure, many of the drawings may be referred to as "schematic" in nature at least because some components (such as the drill rod body of various embodiments) are shown as being transparent to better illustrate the features on the inside of the drill rod or other components being shown as transparent. Other features of the drawings may also be schematic in nature and are presented here for ease of explanation.

Detector drill rod 100 comprises a longitudinally extending body 101 extending along a longitudinal direction 109 between first longitudinal end 102A and second longitudinal end 102B of detector drill rod 100. Body 101 is typically annular in cross-section and comprises: a drill rod outer surface (not enumerated) having a circular cross-section (in cross-sectional planes orthogonal to longitudinal direction 109); and a drill rod bore-defining 101A (typically, but not necessarily circularly shaped in cross-sectional planes orthogonal to longitudinal direction 109) that is shaped to define a drill rod bore 103 that extends along longitudinal direction 109 and radially from central axis 109A. A muon detector assembly 105 is housed in drill rod bore 103. In some embodiments, a plurality of muon detector assemblies 105, which may be longitudinally spaced apart, are housed in drill rod bore 103. Muon detector assembly 105 comprises one or more muon sensor(s) 107 responsive to muons interacting therewith. In some embodiments, muon detector assembly 105 comprises a plurality of muon sensors 107. Muon detector assembly 105 and one or more muon sensor(s) 107 are shaped and dimensioned to fit within drill rod bore 103. By locating muon detector assembly 105 and one or more muon sensor(s) 107 in drill rod bore 103, detector drill rod 100 may shield muon detector assembly 105 and one or more muon sensor(s) 107 from borehole environment factors such as borehole blockage due to ingress of debris, partial or full collapse of borehole, etc. The integration of muon detector assembly 105 and one or more muon sensor(s) 107 into a drill rod (detector rod 100) also makes the deployment of muon detectors feasible with existing tools and therefore more economical.

Muon detector assembly 105 and/or muon sensor(s) 107 may be located at any suitable location within drill rod bore 103. In the FIG. 3 embodiment, muon detector assembly 105 and muon sensor(s) 107 are located at about a longitudinal midsection 103B of drill rod bore 103. However, this is not necessary. Muon detector assembly 105 and/or muon sensor(s) 107 may additionally or alternatively be located in region 103A between first end 102A and midsection 103B and/or in region 103C between second 102B and midsection 103B. Muon sensor(s) 107 may comprise any suitable muon sensors.

Muon detector assembly 105 may further comprise a communication device 108 located in drill rod bore 103 configured to receive signals from one or more muon sensor(s) 107, to process such signals to provide communication data and to communicate such data to a suitable up-hole communication device (not shown). Communication device 108 may also receive data (e.g. instructions, calibration parameters and/or the like) from the up-hole communication device. Communication device 108 may comprise any suitable communication device, for example, Ethernet, RS485 cables, etc. Typically, the communication between communication device 108 and the up-hole communication device is wired communication, although this is not necessary and wireless borehole communication (such as mud-pulse telemetry and/or the like) could be used for such communication. Communication device 108 is shaped and/or dimensioned to fit within drill rod bore 103 and may be located in any of region 103A, midsection 103B or region 103C.

Muon detector assembly 105, communication device 108 and/or muon sensor(s) 107 may be secured to their respective location(s) within drill rod bore 103 by any suitable means. In some embodiments, muon detector assembly 105, communication device 108 and/or muon sensor(s) 107 are affixed to structures within drill rod bore 103. In some embodiments, muon detector assembly 105, communication device 108 and/or muon sensor(s) 107 are affixed to and/or abut against drill rod bore-defining 101A. In some embodiments, some components of muon detector assembly 105, communication device 108 and/or muon sensor(s) 107 are affixed to structures within drill rod bore 103 and other components of muon detector assembly 105, communication device 108 and/or muon sensor(s) 107 are affixed to drill rod bore-defining 101A.

Figure 1:
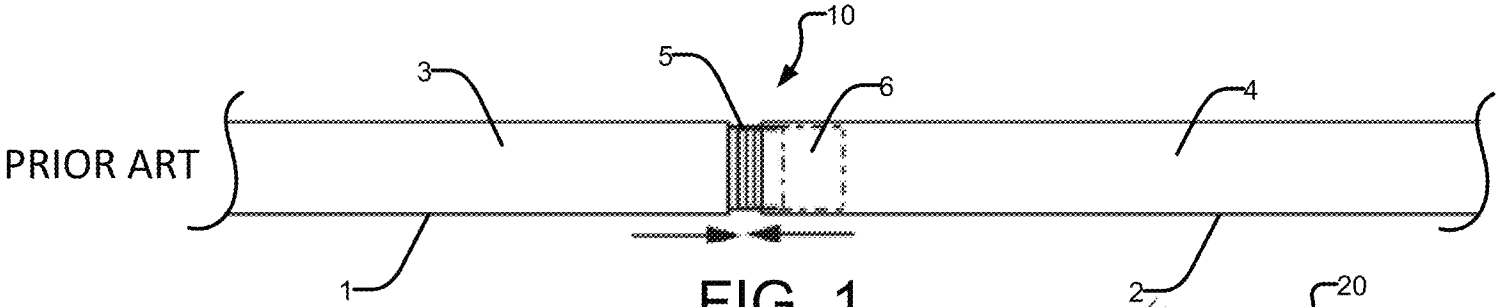
FIG. 1 is a schematic side view of a conventional prior art drill rod coupling of two drill rods.

Detector drill rod 100 further comprises a first connector 111A at first end 102A and a second connector 111B at second end 102B. First and second connectors 111A, 111B are complementary to one another. First and second connectors 111A, 111B are each configured to engage with complementary connectors of other drill rods (for example, connector 5 of drill rod 1 and connector 6 of drill rod 2 as shown in FIG. 1) to securely connect detector drill rod 100 with such other drill rods to form a drill string that includes detector drill rod 100. First and second connectors 111A, 111B may comprise complementary threaded connectors for threadable connection to corresponding connectors of other drill rods, although first and second connectors 111A, 111B may comprise any suitable means for engaging with other connector units of other drill rods.

Muon detector assembly 105 may be located and/or shaped to provide a fluid flow passage 112 between the ends 102A, 102B of detector drill rod 100 within drill rod bore 103. Such a fluid flow passage 112 may flow through muon detector assembly 105 or around muon detector assembly 105. In some embodiments, muon detector assembly 105 may define a portion of such fluid flow passage 112. Fluid flow passage 112 permits the flow of drilling fluid and/or rock cuttings (drilling debris) in longitudinal directions 109 through drill rod bore 103 for communication with the bores of adjacent drill rods in a drill string. In this manner, a drill string which includes one or more detector drill rods 100 (among other drill rods) may be used for drilling. In some circumstances, this drilling with detector rods 100 may be limited to clearing debris from a previously drilled borehole (e.g. to mitigate issues associated with ingress of debris into the previously drilled borehole and/or collapse of the previously drilled borehole), although this limitation is not necessary and a drill string comprising one or more detector drill rods 100 may be used for drilling generally.

Detector drill rod 100 may be deployed in a drill string. First, muon detector assembly 105 may be inserted into drill rod bore 103 from one of longitudinal ends 102A, 102B, extended longitudinally into drill rod bore 103 and secured within drill rod bore 103. Then, the assembled detector drill rod 100 may be incorporated into a drill string by connecting to a drill rod at an upstream end of the drill string (e.g. at a drill rig on the surface). After incorporating detector drill rod 100 into the drill string, one or more subsequent drill rods (including one or more additional detector drill rods) may be incorporated into the drill string to further extend the drill string downhole.

Figure 4A:
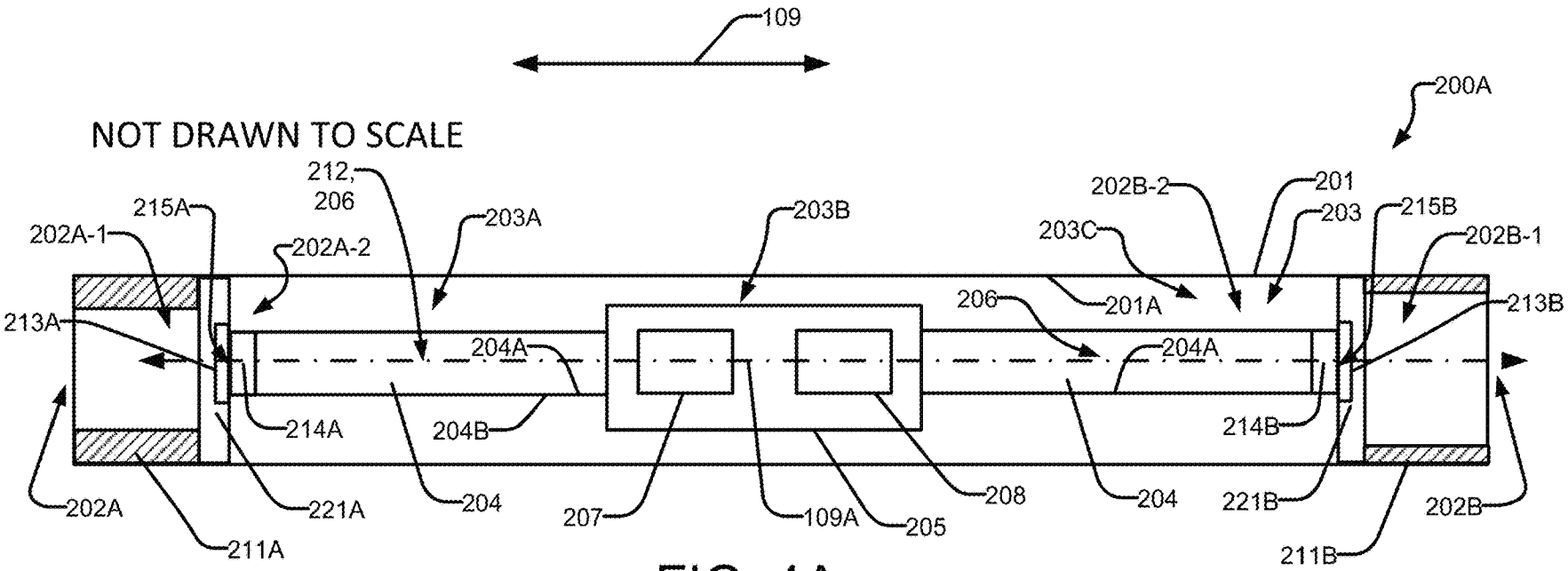
FIG. 4A is a schematic side view of a detector drill rod according to another example embodiment.

FIG. 4A is a schematic side view of a detector drill rod 200A according to another example embodiment.

Detector drill rod 200A comprises a longitudinally extending conduit 204 extending from a longitudinal first end 202A to a longitudinal second end 202B of detector drill rod 200 along longitudinal direction 109 within drill rod bore 203 defined by drill rod body 201. Conduit 204 comprises a conduit bore-defining 204A that is shaped to define a conduit bore 206 for permitting fluid flow through conduit 204. That is, conduit 204 (and specifically conduit bore 206) provide at least a portion of fluid flow passage 212 between the longitudinal ends 202A, 202B of detector drill rod 200. Conduit 204 (conduit bore 206; fluid flow passage 212) facilitates the flow of drilling fluid and/or rock cuttings (drilling debris) through drill rod 200 in longitudinal directions 109 for communication with the bores of adjacent drill rods in a drill string.

Conduit 204 may be of any suitable shape, size and/or construction to facilitate fluid flow through drill rod 200 via conduit bore 206 (fluid flow passage 212) in any suitable manner. Conduit 204 as shown in FIG. 4A is merely one possible implementation and conduits similar to conduit 204 of the FIG. 4 embodiment may comprise other orientations, configurations and/or relationship with other elements of drill rod 200 while providing at least a portion of fluid flow passage 212 between longitudinal ends 202A, 202B of detector drill rod 200.

Conduit 204 as described herein may also be applied to and/or used in any of the other detector drill rods (e.g. detector drill rods 100, 200B, 200C, 300 and 400) disclosed herein.

Detector drill rod 200 of the illustrated embodiment comprises a first seal 221A. First seal 221A may be located at or near first longitudinal end 202A, although this location is not necessary and first seal 221A could be located anywhere closer to first longitudinal end 202A than second seal 221B (discussed in more detail below). First seal 221A comprises a first seal connector component 213A configured to form a fluid-impermeable connection 215A with a corresponding first complementary conduit connector component 214A of conduit 204. When connection 215A is made between seal connector components 213A and conduit connector component 214A, fluid flow is permitted between conduit bore 206 and a longitudinal first side 202A-1 of first seal 221A while fluid is prevented from penetrating a longitudinal second side 202A-2 of first seal 221A in a region exterior to conduit 204. First seal 221A may engage with drill rod bore-defining 201A in any suitable manner to prevent fluid from entering second side 202A-2 of first seal 221A in a region exterior to conduit 204. In some embodiments, first seal 221A is welded to drill rod bore-defining 201A.

First seal connector component 213A and first complementary conduit connector component 214A may comprise any suitable means for forming fluid-impermeable connection 215A. In some embodiments, first seal connector component 213A has a male end and first complementary conduit connector component 214A has a female end. In other embodiments, first seal connector component 213A has a female end and first complementary conduit connector component 214A has a male end.

In some embodiments, first seal connector component 213A engages with first complementary conduit connector component 214A through relative longitudinal movement along longitudinal directions 109. In some embodiments, first seal connector component 213A engages with first complementary conduit connector component 214A through relative rotational movement about a longitudinal axis 109A of conduit 204. In some embodiments, first seal connector component 213A engages with first complementary conduit connector component 214A through both relative longitudinal movement along longitudinal directions 109 and relative rotational movement about longitudinal axis 109A. In some embodiments, first seal connector component 213A and first complementary conduit connector component 214A are threaded and threadably connectable to each other.

Detector drill rod 200 of the illustrated embodiment comprises a second seal 221B. Second seal may be located at or near second end 102B, although this location is not necessary and second seal 221B could be located anywhere closer to second end 102B than first seal 221A. Second seal 221B comprises a second seal connector component 213B configured to form a fluid-impermeable connection 215B with a corresponding second complementary conduit connector component 214B of conduit 204. When connection 215B is made between seal connector component 213B and conduit connector component 214B, fluid flow is permitted between conduit bore 206 and a longitudinal first side 202B-1 of second seal 221B while preventing fluid from penetrating a longitudinal second side 202B-2 of second seal 221B in a region exterior to conduit 204.

Second seal connector component 213B and second complementary conduit connector component 214B may comprise any suitable means for forming fluid-impermeable connection 215B. In some embodiments, second seal connector component 213B has a male end and second complementary conduit connector component 214B has a female end. In other embodiments, second seal connector component 213B has a female end and second complementary conduit connector component 214B has a male end.

In some embodiments, second seal connector component 213B engages with second complementary conduit connector component 214B through relative longitudinal movement along longitudinal directions 109. In some embodiments, second seal connector component 213B engages with second complementary conduit connector component 214B through relative rotational movement about longitudinal axis 109A. In some embodiments, second seal connector component 213B engages with second complementary conduit connector component 214B through both relative longitudinal movement along longitudinal directions 109 and relative rotational movement about longitudinal axis 109A. In some embodiments, second seal connector component 213B and second complementary conduit connector component 214B are threaded and threadably connectable to each other.

Second seal 221B may engage with drill rod bore-defining 201A in any suitable manner to prevent fluid from entering second side 202B-2 of second seal 221B in a region exterior to conduit 204. In some embodiments, second seal 221B is detachably connectable to second seal connector component 213B and removable from drill rod bore 203. Advantageously, this detachable connectability of second seal 221B may permit the insertion of conduit 204 and/or muon detector assembly 205 into drill rod bore 203. Second seal 221B may be shaped to be extendable into drill rod bore 203 and to complement the cross-sectional shape of drill rod bore-defining 201A such that when second seal 221B extends into drill rod bore 203 and is coupled to second seal connector component 213B, second seal 221B prevents fluid from entering second side 202B-2 of second seal 221B in a region external to conduit 204. In some embodiments, second seal 221B and second seal connector component 213B are detachable from second conduit connector component 214B and are removable from drill rod bore 203. Advantageously, this detachable connectability of second seal 221B and second seal connector component 213B may permit the insertion of conduit 204 and/or muon detector assembly 205 into drill rod bore 203. Second seal 221B and second seal connector component 213B may be shaped to be extendable into drill rod bore 203 and second seal 221B may be shaped to complement the cross-sectional shape of drill rod bore-defining 201A such that when second seal 221B and second seal connector component 213B extend into drill rod bore 203 and second seal connector component 213B is coupled to second conduit connector component 214B, second seal 221B prevents fluid from entering second side 202B-2 of second seal 221B in a region external to conduit 204.

First and second seals 221A and 221B as described herein may also be applied to and/or used in any of the other detector drill rods (e.g. detector drill rods 100, 200B, 200C, 300 and 400) disclosed herein.

Muon detector assembly 205 may further comprise a communication device 208 located in drill rod bore 203 configured to receive signals from one or more muon sensor(s) 207, to process such signals to provide communication data and to communicate such data to a suitable up-hole communication device (not shown). Communication device 208 may also receive data (e.g. instructions, calibration parameters and/or the like) from the up-hole communication device. Communication device 208 may comprise any suitable communication device, for example, Ethernet, RS485 cables, and/or the like. Typically, the communication between communication device 208 and the up-hole communication device is wired communication, although this is not necessary and wireless borehole communication (such as mud-pulse telemetry and/or the like) could be used for such communication. Communication device 208 is shaped and/or dimensioned to fit within drill rod bore 203 and may be located in any of region 203A, midsection 203B or region 203C.

In some embodiments, muon detector assembly 205, muon sensor(s) 207 and/or communication device 208 are attached to an outer conduit surface 204B of conduit 204 such that muon detector assembly 205, muon sensor(s) 207 and/or communication device 208 are securely mounted within drill rod bore 203 and at least somewhat insulated from environmental factors such as heat and/or vibration generated from the operation of the drill string containing detector drill rod 200. Muon sensor(s) 207 and/or communication device 208 may be attached to outer conduit surface 204B by any suitable means, including for example by threaded connection, welding and/or the like.

Detector drill rod 200A may be deployed in a drill string. Muon detector assembly 205 may be securely attached (e.g. mounted) to conduit 204 (e.g. to the exterior surface of conduit 204) so that muon detector assembly is located exterior to conduit 204. Then, the combined conduit 204 with muon detector assembly 205 may be inserted into drill rod bore 203 from longitudinal end 202B and extended longitudinally into drill rod bore 203. Conduit 204 may then be connected to first seal 221A and sealed to provide a fluid-impermeable connection at first longitudinal end 202A. Second seal 221B may then be inserted into drill rod bore 203 from longitudinal end 202B to be connected to conduit 204 and provide a fluid-impermeable connection at second longitudinal end 202B, such that fluid is prevented from penetrating side 202A-2 of first seal 221A and side 202B-2 of second seal 221B in a region exterior of conduit 204 and interior to drill rod bore-defining surface 201A. Then, the assembled detector drill rod 200 may be incorporated into a drill string by connecting to a drill rod at an upstream end of the drill string (e.g. at a drill rig on the surface). After incorporating detector drill rod 200 into the drill string, one or more subsequent drill rods (including one or more additional detector drill rods) may be incorporated into the drill string to further extend the drill string downhole.

Figure 4B:
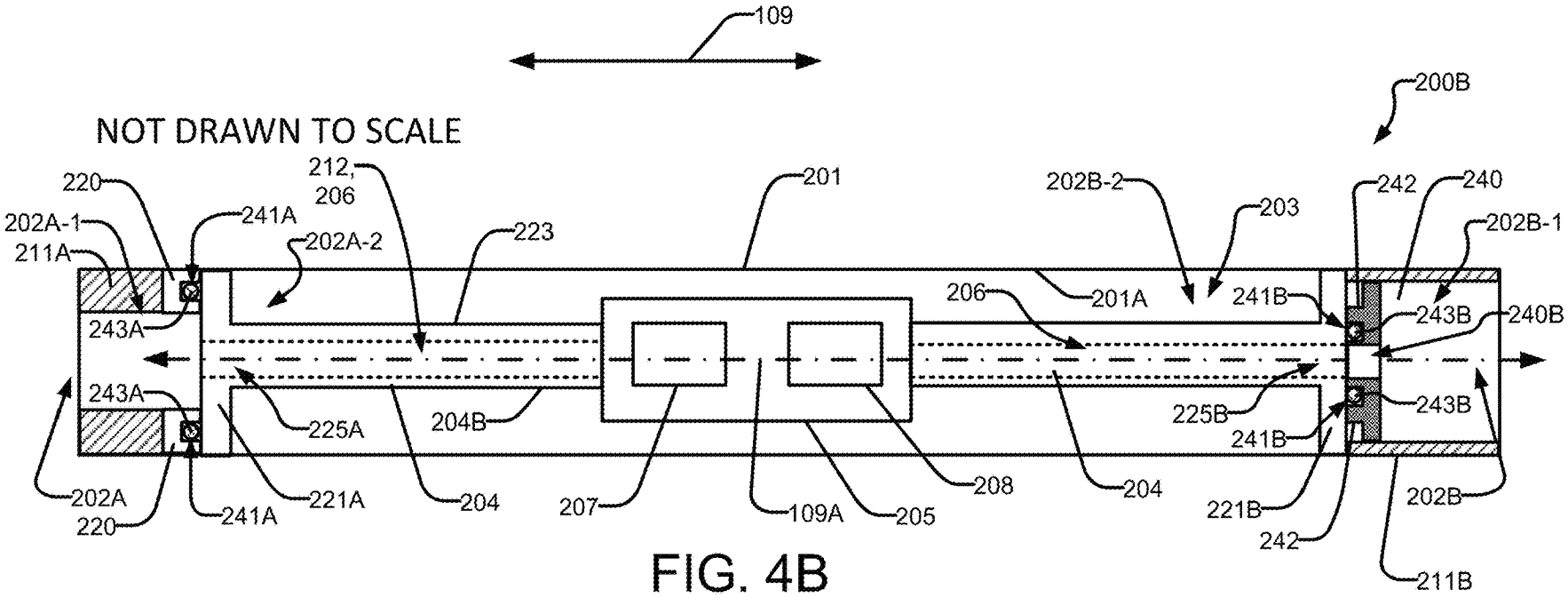
FIG. 4B is a schematic side view of a detector drill rod according to another example embodiment.

FIG. 4B is a schematic side perspective view of a detector drill rod 200B according to another example embodiment. Detector drill rod 200B is similar in many respects to detector drill rod 200 described elsewhere herein and, except where indicated herein, may comprise features of detector drill rod 200. Conduit 204 of detector drill rod 200B is joined (e.g. by welding) or integrally formed with first seal 221A at location 225A and with second seal 221B at location 225B to form a unitary conduit/seal member 223. Unitary conduit/seal member 223 defines a fluid flow passageway 212 that includes a conduit bore portion 206.

In the illustrated embodiment, conduit bore 206 extends longitudinally between first end 202A and second end 202B of detector drill rod 200B, although this is not necessary and conduit bore 206 may extend over a sub-portion of detector drill rod 200B. Detector drill rod 200B of the illustrated embodiment comprises a shoulder 220 located between connector 211A and unitary conduit/seal member 223. In the illustrated embodiment, shoulder 220 changes (e.g. reduces) a cross-sectional dimension of drill rod bore 203 and may provide a longitudinal face (e.g. an annular longitudinal-facing surface) in drill rod bore 203. Shoulder 220 of the illustrated embodiment may be shaped to provide one or more longitudinally opening annular grooves 241A for accommodating one or more corresponding ring seals 243A. Ring seal(s) 243A may be located in longitudinally opening annular grooves 241A to provide a fluid-impermeable connection between shoulder 220 and a longitudinal face of first seal 221A unitary conduit/seal member 223 such that fluid is prevented from penetrating second side 202A-2 of first seal 221A in a region exterior of conduit 204 from a first side 202A-1 through any space between first seal 221A and drill rod bore-defining surface 201A. In some embodiments, one or more annular grooves may additionally or alternatively be provided in the longitudinal face of first seal 221A for accommodating one or more corresponding ring seals to provide this sealing functionality.

In the illustrated embodiment, detector drill rod 200B also comprises a threaded insert 240 for helping to secure unitary conduit/seal member 223 and muon detector assembly 205 in drill rod bore 203. Threaded insert 240 of the illustrated embodiment is annular in cross-section for permitting fluid communication with conduit bore 206 through an insert bore 240A. In the illustrated embodiment, threaded insert 240 is threaded on its exterior circumferential surface for threadably engaging corresponding internal threads on connector 11B. After unitary conduit/seal member 223 (and muon detector assembly 205 which may be mounted to unitary conduit/seal member 223) are inserted longitudinally into drill rod bore 203 from end 202B, threaded insert 240 may be threadably inserted into dill rod bore 203 via end 202B by engaging with threads 211B until projecting portion 242 of insert 240 abuts second seal 221B. Shoulder 220 and insert 240 together secure unitary conduit/seal member 223 (and muon detector assembly 205 which may be mounted to unitary conduit/seal member 223) within drill rod bore 203.

In the illustrated embodiment, a longitudinal face of projecting portion 242 of insert 240 is shaped to define one or more longitudinally opening annular grooves 241B which accommodate corresponding ring seal(s) 243B. Ring seal(s) 243B may be inserted into longitudinally opening groove(s) 241B to provide a fluid-impermeable connection between a longitudinal face of insert 240 and a longitudinal face second seal 221B of unitary conduit/seal member 223 such that fluid is prevented from penetrating a second side 202B-2 of second seal 221B in a region exterior of conduit 204 from a first side 202B-1 through any space between second seal 221B and insert 240 as well as any space between second seal 221B and drill bore bore-defining 201A. In some embodiments, one or more annular grooves may additionally or alternatively be provided in the longitudinal face of second seal 221B for accommodating one or more corresponding ring seals to provide this sealing functionality. In some embodiments, the functionality of threaded insert 240 (e.g. to seal fluid out of space 202B-2 and to secure unitary conduit/seal member 223 (and muon detector assembly 205 which may be mounted to unitary conduit/seal member 223) may be provided by the threaded male connector 211A of an adjacent drill rod in the drill string.

In use, muon detector assembly 205 may be mounted onto unitary conduit/seal member 223 and then inserted into drill rod bore 203 from second end 202B towards first end 202A until unitary conduit/seal member 223 abuts shoulder 220 at first end 202A. Unitary conduit/seal member 223 of detector drill rod 200C may then be secured within drill rod bore 203 by threaded insert 240 by threadably extending insert 240 from second end 202B towards first end 202A until projecting portion 242 of insert 240 abuts unitary conduit/seal member 223. Unitary conduit/seal member 223 and insert 240 as described herein may also be applied to and/or used in any of the other detector drill rods (e.g. detector drill rods 100, 200A, 200C, 300 and 400) disclosed herein.

Figure 4C:
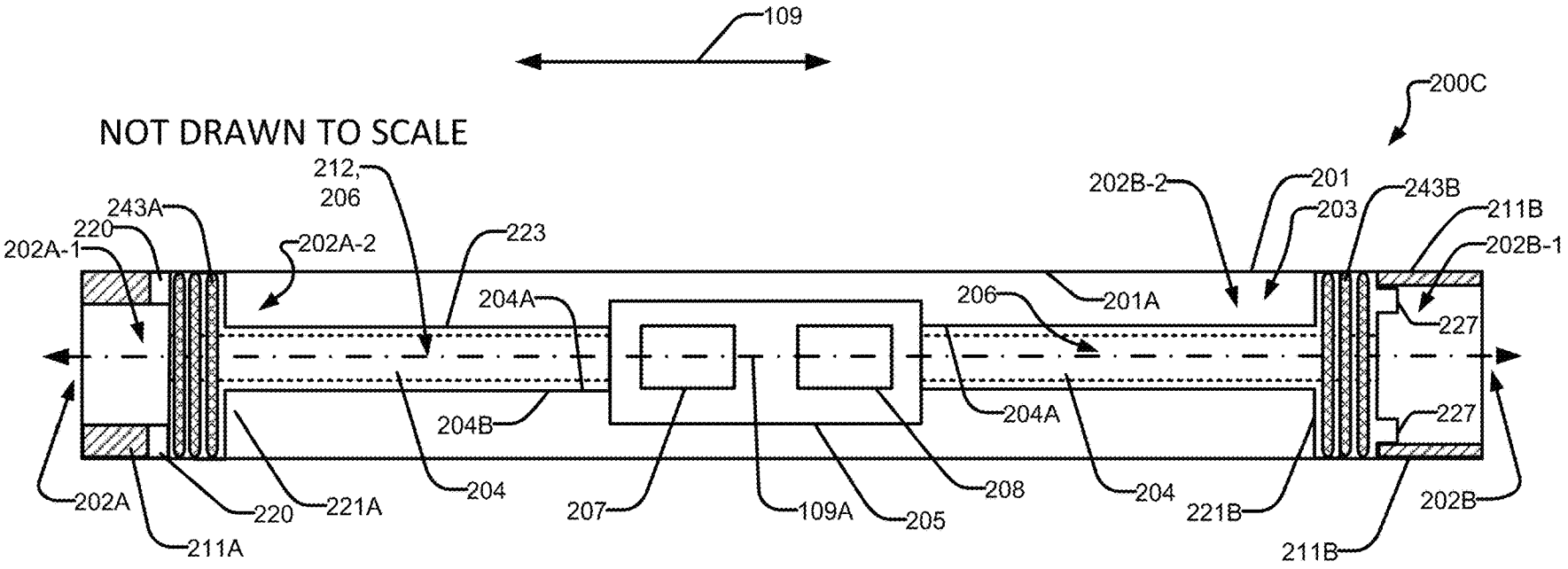
FIG. 4C is a schematic side view of a detector drill rod according to another example embodiment.

FIG. 4C is a schematic side perspective view of a detector drill rod 200C according to another example embodiment. Detector drill rod 200C is similar in many respects to detector drill rod 200 described elsewhere herein and, except where indicated herein, may comprise features of detector drill rod 200. Similar to detector drill rod 200B, detector drill rod 200C comprises a unitary conduit/seal member 223 where conduit 204, first seal 221A and second seal 221B are integrally formed or welded to one another, except that the unitary conduit/seal member 223 of detector drill rod 200C.

Unitary conduit/seal member 223 of the FIG. 4C embodiment, abuts shoulder 220 at first end 202A. In the FIG. 4C embodiment, first seal 221A of unitary conduit/seal member 223 is shaped to define a plurality of circumferential grooves shaped to accommodate a corresponding plurality of ring seals 243A. Ring seals 243A prevent fluid from penetrating a region on second side 202A-2 of first seal 221A exterior of conduit 204 from first side 202A-1 through any space between unitary conduit/seal member 223 and drill rod bore-defining 201A. Similarly, second seal 221B of unitary conduit/seal member 223 is shaped to define a plurality of circumferential grooves shaped to accommodate a corresponding plurality of ring seals 243B. Ring seals 243B prevent fluid from penetrating a region on second side 202B-2 of second seal 221B exterior of conduit 204 from first side 202B-1 through any space between unitary conduit/seal member 223 and drill rod bore-defining 201A.

In the FIG. 4C embodiment, second seal 221B is also provided with a spacer portion 227 having a reduced cross-sectional dimension (as compared to the rest of seal 221B). Spacer portion may extending longitudinally into connector 211B.

In use, muon detector assembly 205 may be mounted onto unitary conduit/seal member 223 and then inserted into drill rod bore 203 from second end 202B towards first end 202A until unitary conduit/seal member 223 abuts shoulder 220 at first end 202A. Unitary conduit/seal member 223 of detector drill rod 200C may then be secured within drill rod bore 203 by a male end of an adjacent drill rod (not shown) being threadably connected to detector drill rod 200C at end 202B through engagement with threads 211B. The male end of the adjacent drill rod extends into drill rod bore 203 until it abuts spacer portion 227 of second seal 221B. The unitary conduit/seal member 223 and ring seals 243A, 243B as described herein may also be applied to and/or used in any of the other detector drill rods (e.g. detector drill rods 100, 200A, 200B, 300 and 400) disclosed herein.

Figure 5:
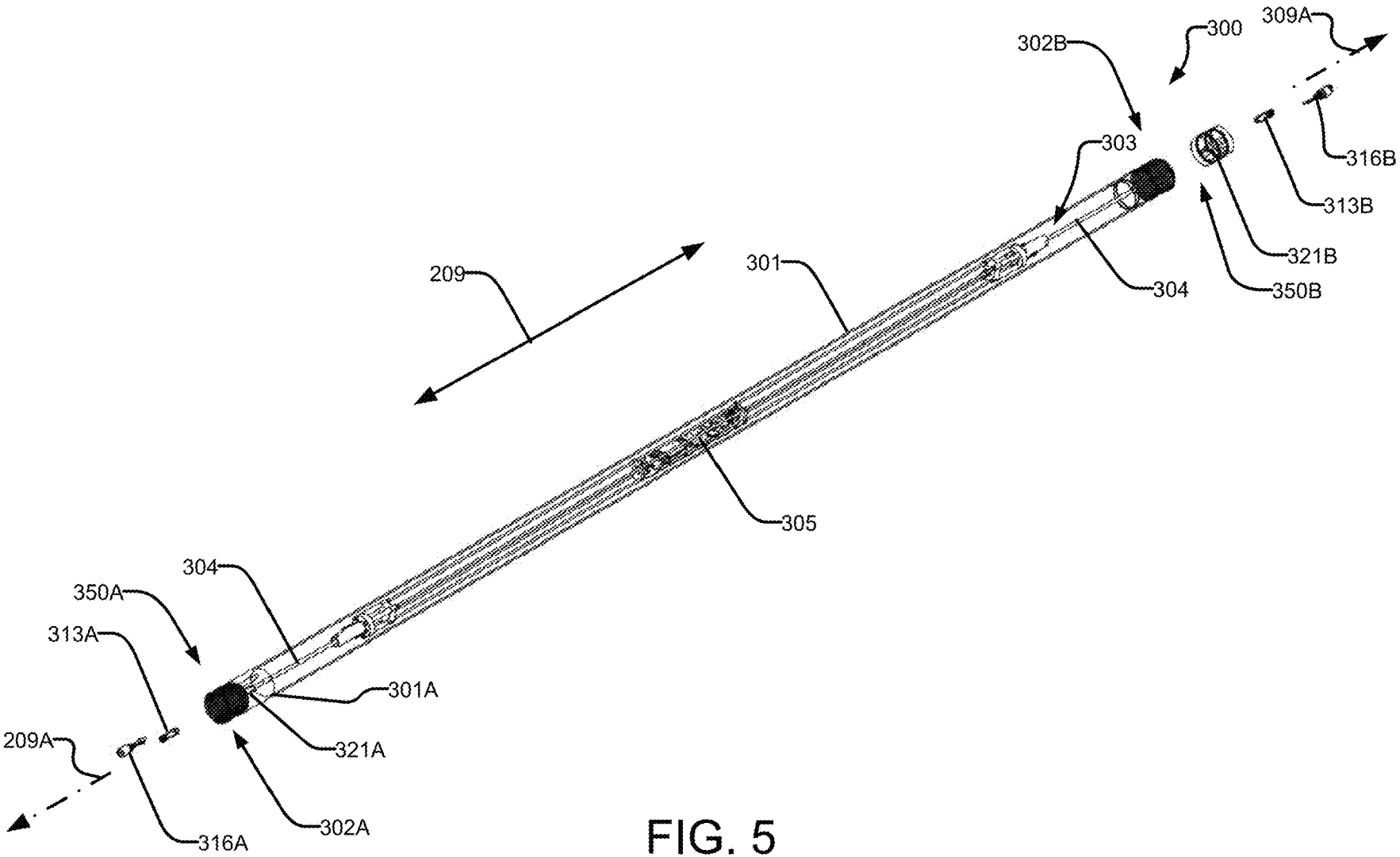
FIG. 5 is an exploded schematic perspective view of a detector drill rod according to another example embodiment.

FIG. 5 is an exploded perspective view of a detector drill rod 300 according to another example embodiment.

Detector drill rod 300 comprises a first sealing mechanism 350A, which in the illustrated embodiment, is located at first end 302A, for sealing drill rod body 301 and conduit 304 on first end 302A and a second sealing mechanism 350B, which in the illustrated embodiment, is located at second end 302B for sealing drill rod body 301 and conduit 304 on second end 302B. In general, sealing mechanisms 350A, 350B need not be located at ends 302A, 302B. It is sufficient that first sealing mechanism 350A be closer to first end 302A than second sealing mechanism 350B and that second sealing mechanism 350B be closer to second end 302B than first sealing mechanism 350A.

First sealing mechanism 350A comprises a welded disk 321A welded to drill rod bore-defining 301A of drill rod body 301. Welded disk 321A is shaped to define a disk central hole at a central location of a cross section of welded disk 321A in a cross-sectional plane perpendicular to longitudinal direction 209 as well as a disk feedthrough hole for facilitating cable connection between a first side of welded disk 321A and a second side of welded disk 321A where the second side is longitudinally opposite to the first side. First sealing mechanism 350A comprises a first sealing plug 313A configured to seal the disk central hole in welded disk 321A and a first feedthrough plug 316A configured to seal the disk feedthrough hole. Details of first sealing mechanism 350A are described further below in reference to FIGS. 6, 7, 8A and 8B.

Second sealing mechanism 350B comprises a sealing cap 321B configured to seal second end 302B of drill rod body 301 by extending into drill rod bore 303 at second end 302B. Sealing cap 321B is shaped to define a cap central hole at a central location of a cross section of sealing cap 321B in a cross-sectional plane perpendicular to longitudinal direction 209 as well as a cap feedthrough hole for facilitating cable connection between a first side of sealing cap 321B and a second side of sealing cap 321B where the second side is longitudinally opposite to the first side. Second sealing mechanism 350B comprises a second sealing plug 313B configured to seal the cap central hole in sealing cap 321B and a second feedthrough plug 316B configured to seal the cap feedthrough hole. Details of second sealing mechanism 350B are described further below in reference to FIGS. 8A, 8B, 9 and 10.

Figure 6:
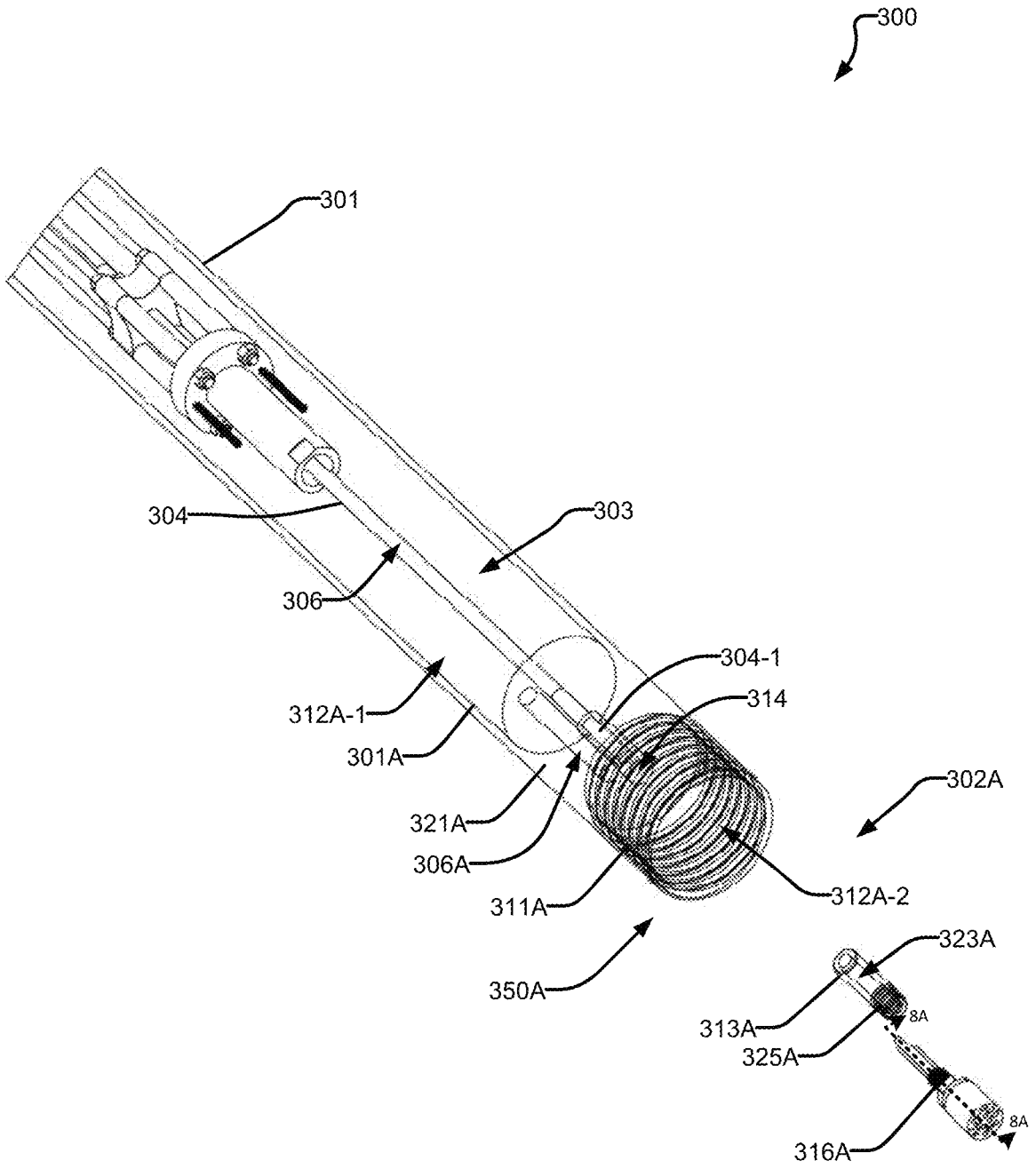
FIG. 6 is a partial exploded schematic perspective view showing one end of the detector drill rod of FIG. 5 according to an example embodiment.

FIG. 6 is a partial exploded perspective view of detector drill rod 300 showing first sealing mechanism 350A at first end 302A according to an example embodiment.

Welded disk 321A (which is shown as transparent in FIG. 5) is shaped to define a disk central hole 314 and a disk feedthrough hole 306A. A first end 304-1 of conduit 304 extends from a first side 312A-1 of welded disk 321A into disk central hole 314. First sealing plug 313A extends from a second side 312A-2 of welded disk 321A into disk central hole 314. First sealing plug 313A is shaped to define a first sealing plug bore 323A with a dimension such that as first sealing plug 313A extends into disk central hole 314, first end 304-1 of conduit 304 also extends into first sealing plug bore 323A therefore facilitating fluid flow between first and second sides 312A-1 and 312A-2 of welded disk 321A via the fluid passageway 212 defined by first sealing plug bore 323A and conduit bore 306.

In some embodiments, first sealing plug 313A is shaped to define grooves 325A on an exterior surface of first sealing plug 313A where grooves 325A are shaped to facilitate insertion of ring seals into grooves 325A to form a fluid-impermeable connection between first sealing plug 313A and disk central hole 314 of welded disk 321A, thus preventing fluid from entering a region of drill rod bore 303 exterior to conduit 304 on first side 312A-1 of welded disk 321A through any space between first sealing plug 313A and the portion of disk 321A that defines disk central hole 314.

First feedthrough plug 316A is configured to extend into first feedthrough hole 306A of welded disk 321A to facilitate cable connection between first and second sides 312A-1 and 312A-2 of welded disk 321A.

Figure 8A:
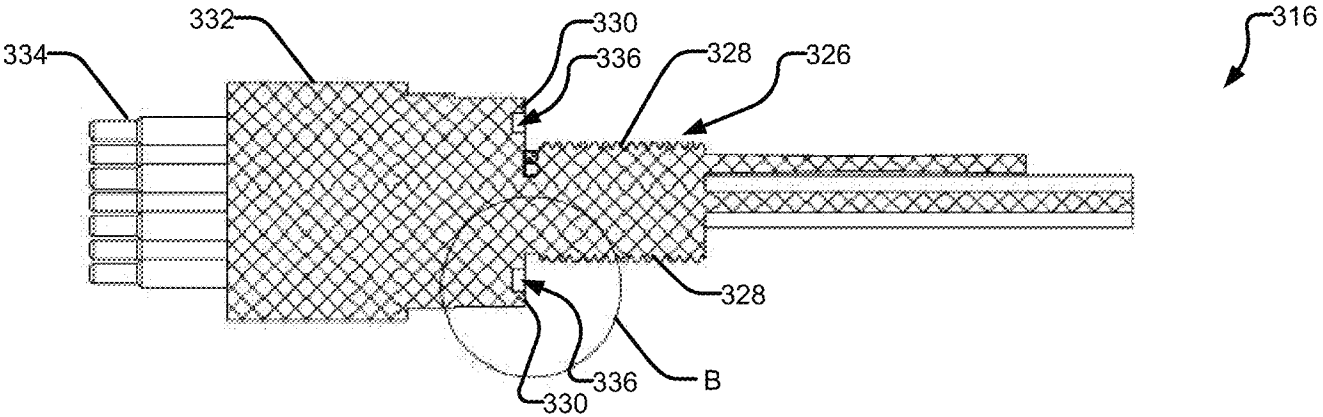
FIG. 8A is cross sectional view along lines 8A-8A of FIG. 6 of a feedthrough plug according to an example embodiment.
Figure 8B:
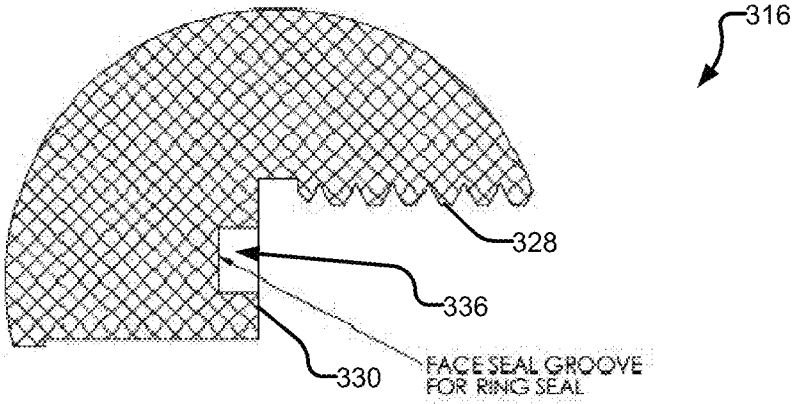
FIG. 8B is an enlarged view of area B of FIG. 8A.

FIG. 8A shows a cross sectional view of feedthrough plug 316A along lines 8A-8A of FIG. 6 according to one example embodiment. FIG. 8B is an enlarged view of area B as shown in FIG. 8A. First feedthrough plug 316A and second feedthrough plug 316B (described further below in relation to second sealing mechanism 350B) may be collectively referred herein to as feedthrough plug 316.

Referring to FIGS. 8A and 8B, feedthrough plug 316 comprises a threaded part 326 comprising threads 328 with a dimension corresponding to, for example, a dimension of first feedthrough hole 306A of welded disk 321A for threadably connecting feedthrough plug 316 to first feedthrough hole 306A. Feedthrough plug 316 comprises shoulders 330 for abutting feedthrough connector portion 332 against welded disk 321A. Shoulders 330 are shaped to define a ring groove 336 for insertion of a ring seal (not shown in FIG. 8A) to provide a fluid-impermeable connection of feedthrough plug 316 to, for example, first feedthrough hole 306A. Feedthrough plug 316 further comprises cable connectors 334 for connection to cables (not shown) such as power cables and/or communications cables. In FIG. 8A, cable connectors 334 comprise male connector ends. However, this is not necessary. In some embodiments, cable connectors 334 comprise female connector ends. In some embodiments, first and second locking sleeves (not shown in FIG. 8A) are provided to be attached respectively to the male and female connector ends of the cable connectors 334 of feedthrough plug 316 and complementary cable connectors of the cables such that upon engagement between the male and female connector ends, the first and second locking sleeves are securely engaged with one another to provide additional locking support for the connection.

Figure 7:
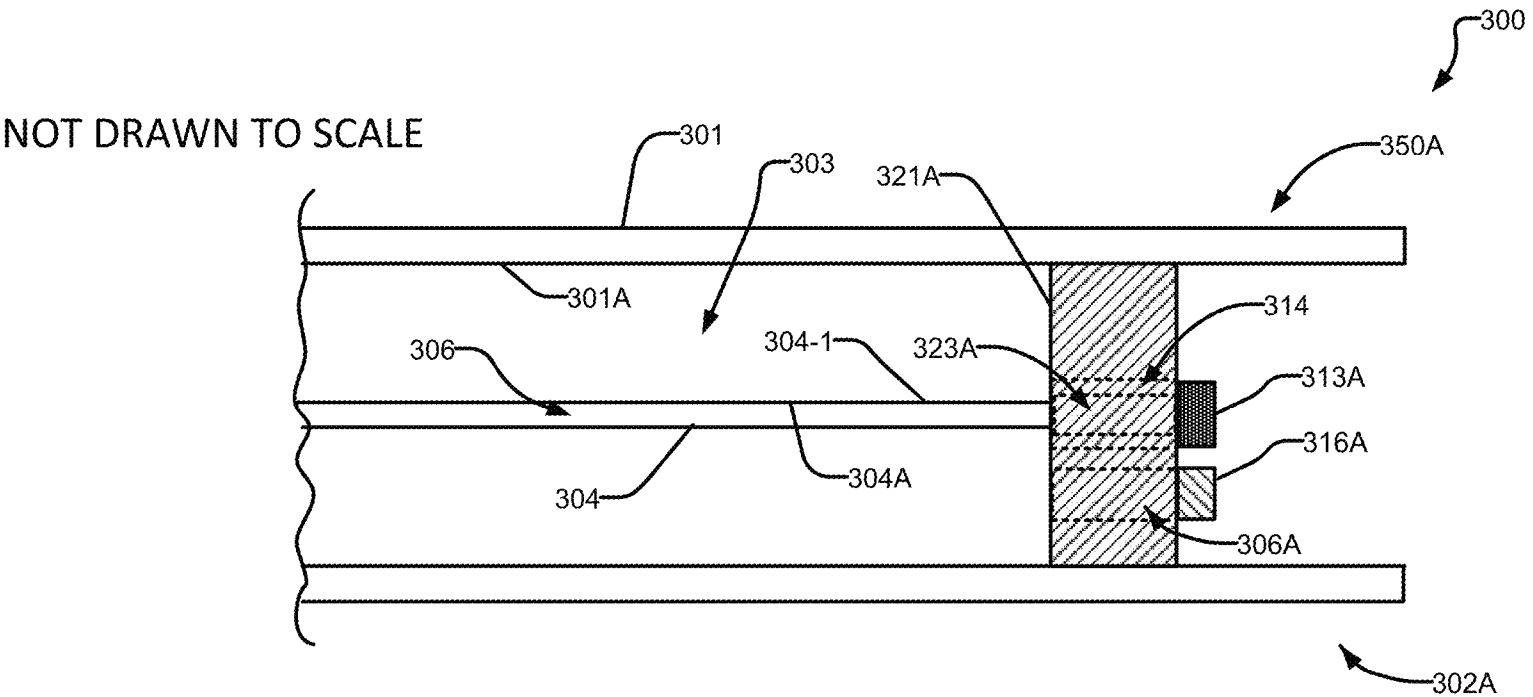
FIG. 7 is a schematic partial side view showing one end of the detector drill rod of FIG. 5 according to an example embodiment.

FIG. 7 is a partial cross-sectional view of detector drill rod 300 showing an assembled first sealing mechanism 350A at first end 302A according to an example embodiment.

In FIG. 7, first sealing mechanism 350A is assembled such that first sealing plug 313A is extended into disk central hole 314 and secured in fluid-impermeable manner against the portion of disk 321A that defines disk central hole 314A and first feedthrough plug 316A is extended into first feedthrough hole 306A and secured in a fluid-impermeable manner against the portion of disk 321A that defines first feedthrough hole 306A. Therefore, first sealing mechanism 350A provides fluid-impermeable sealing on first end 302A of drill rod body 301.

First sealing mechanism 350A as described herein may also be applied to and/or used in any of the other detector drill rods (e.g. detector drill rods 100, 200A-C and 400) disclosed herein.

Figure 9:
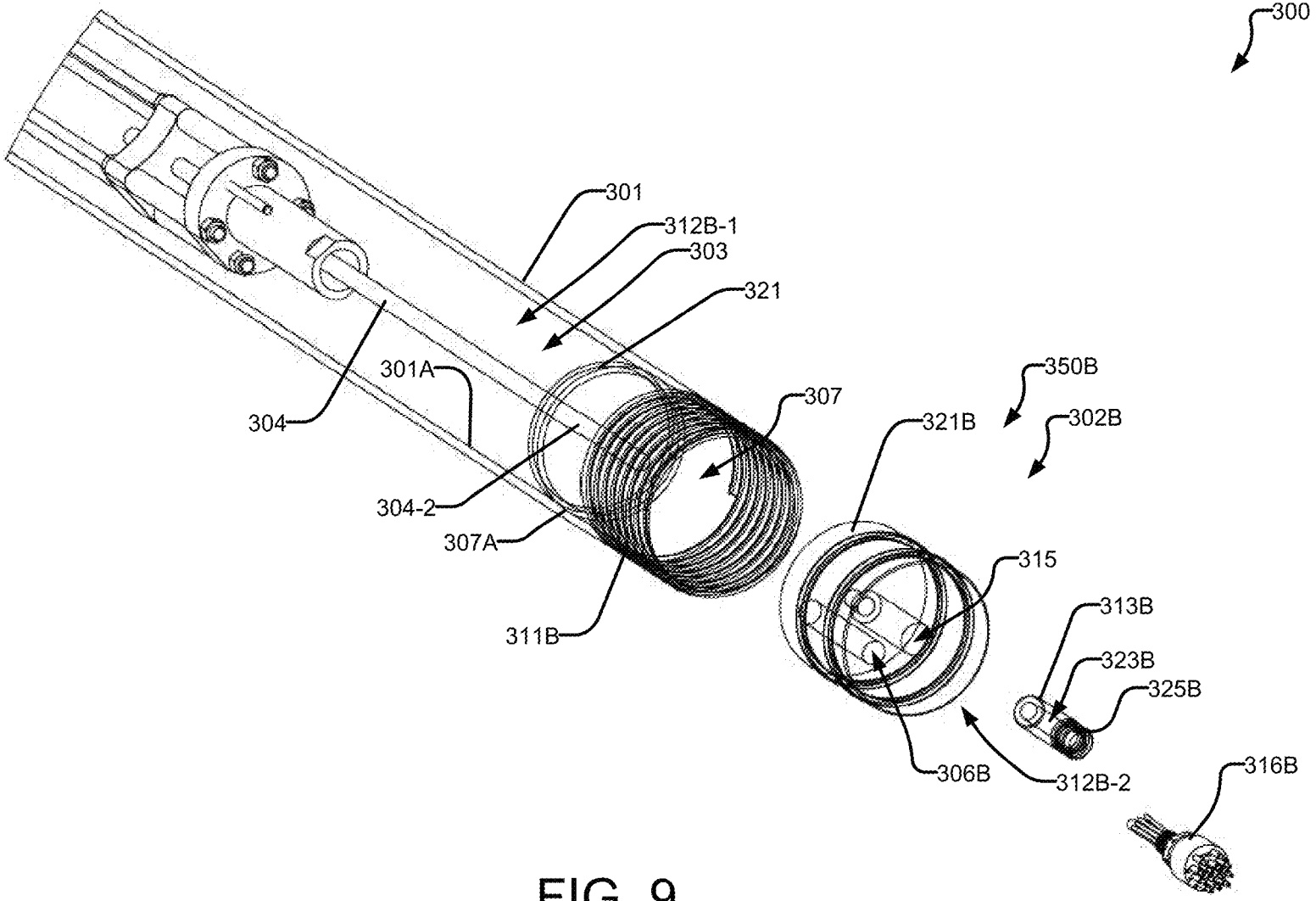
FIG. 9 is a partial exploded schematic perspective view showing another end of the detector drill rod of FIG. 5 according to an example embodiment.
Figure 10:
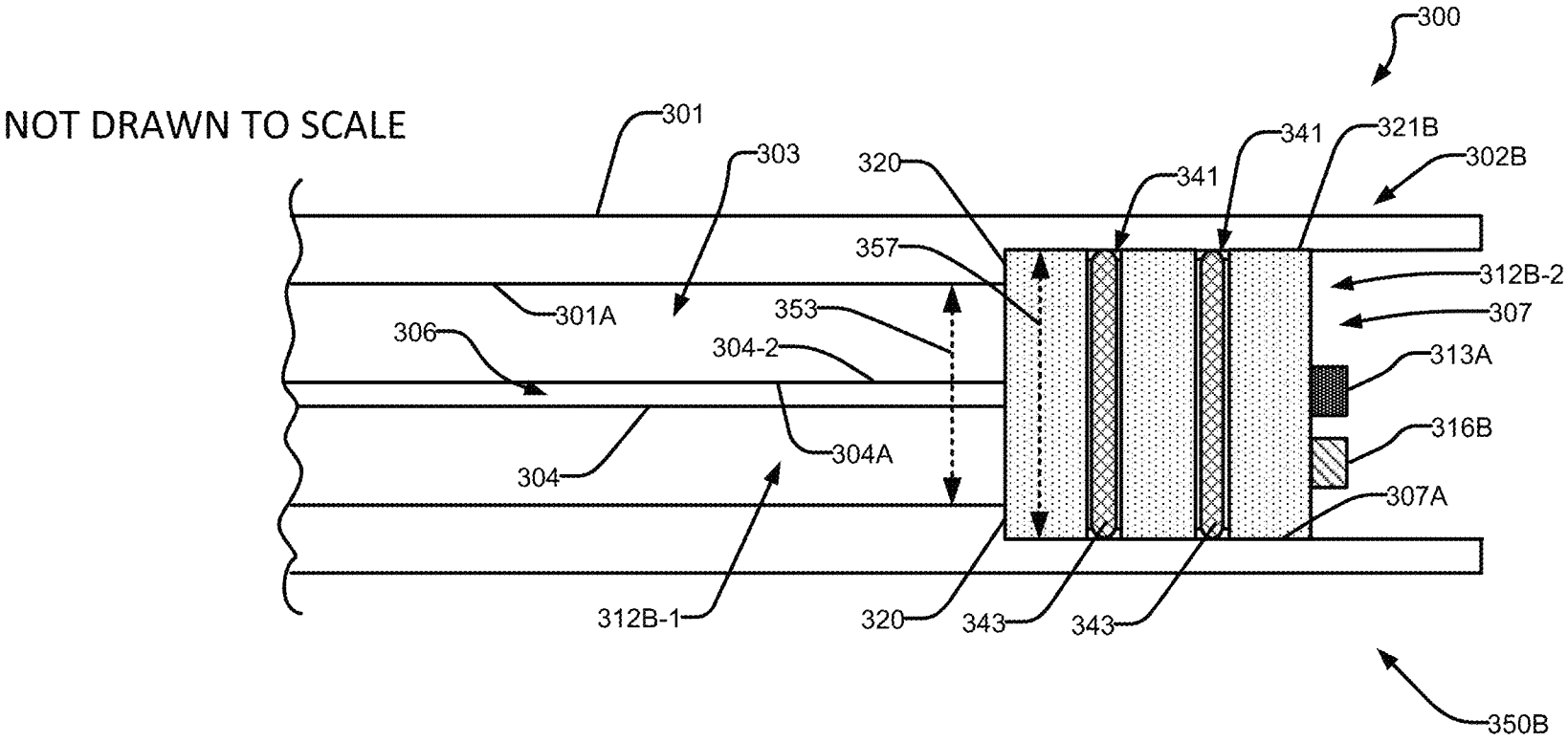
FIG. 10 is a schematic partial side view showing the other end of the detector drill rod of FIG. 5 according to an example embodiment.

FIG. 9 is a partial exploded perspective view of detector drill rod 300 showing second sealing mechanism 350B at second end 302B according to an example embodiment. FIG. 10 is a partial cross-sectional view of detector drill rod 300 showing an assembled second sealing mechanism 350B at second end 302B according to an example embodiment.

Referring to FIGS. 9 and 10, sealing cap 321B is shaped to define a cap central hole 315 and a cap feedthrough hole 306B. A second end 304-2 of conduit 304 extends from a first side 312B-1 of sealing cap 321B into cap central hole 315 when sealing cap 321B located in a connector bore 307 of drill rod bore 303 to form a seal (as shown in FIG. 10). Second sealing plug 313B extends from a second side 312B-2 of sealing cap 321B into cap central hole 315. Second sealing plug 313B is shaped to define a second sealing plug bore 323B and has a cross-sectional dimension such that as second sealing plug 313B extends into cap central hole 315, second end 304-2 of conduit 304 also extends into second sealing plug bore 323B therefore facilitating fluid flow between first and second sides 312B-1 and 312B-2 of sealing cap 321B via the fluid passageway defined by second sealing plug bore 323B and conduit bore 306.

In some embodiments, second sealing plug 313B is shaped to define grooves 325B on an exterior circumferential surface of second sealing plug 313B where grooves 325B are shaped to facilitate insertion of ring seals into grooves 325B to form a fluid-impermeable connection between second sealing plug 313B and the portion of sealing cap 321B that defines cap central hole 315, thus preventing fluid from entering a region of drill rod bore 303 exterior of conduit 304 on first side 312B-1 of sealing cap 321B through cap central hole 315.

Second feedthrough plug 316B is configured to extend into second feedthrough hole 306B of sealing cap 321B to facilitate cable connection between first and second sides 312B-1 and 312B-2 of sealing cap 321B. Second feedthrough plug 316B may function in the same manner as first feedthrough plug 316A by the mechanism described above in relation to FIGS. 8A and 8B to prevent fluid from entering a region of drill rod bore 303 exterior of conduit 304 on first side 312B-1 of sealing cap 321B through cap feedthrough hole 306B.

Referring to FIGS. 9 and 10, sealing cap 321B of the illustrated is shaped to define grooves 341 (shown in FIG. 10) on an exterior circumferential surface of sealing cap 321B. Grooves 341 are shaped to facilitate insertion of ring seals 343 (shown in FIG. 10) into grooves 341 to form an impermeable connection between sealing cap 321B and bore-defining surface 301A of drill rod body 301 (specifically, in the case of the illustrated embodiment, to connector inner surface 307A of connector bore 307 described in more detail below) thus preventing fluid from entering a region of drill rod bore 303 exterior of conduit 304 on first side 312B-1 of sealing cap 321B through any space between bore-defining surface 301A and a circumferential exterior surface of sealing cap 321B.

In the illustrated embodiment of FIG. 10, bore-defining surface 301A of drill rod body 301 is shaped to define a connector bore portion 307 at second end 302B. Connector bore 307 portion has a diameter 357 sized to accommodate sealing cap 321B. Sealing cap 321B may have a diameter slightly less than diameter 357 for snug-fit extension of sealing cap 311B into connector bore portion 307. Drill rod body 301 may be shaped to define shoulders 320 such that diameter 353 of drill rod bore 303 outside of connector bore portion 307 is smaller than diameter 357 of connector bore portion 307. In use, sealing cap 321B may extend through connector bore portion 307 until sealing cap 321B abuts against shoulders 320. In some embodiments, shoulders 320 and/or sealing cap 321B may be provided with longitudinally opening grooves (not shown) for accommodating ring seals (not shown) which may provide additional or alternative sealing to prevent fluid from entering a region of drill rod bore 303 exterior of conduit 304 on first side 312B-1 of sealing cap 321B through any space between bore-defining surface 301A and sealing cap 321B.

Similar to first sealing mechanism 350A at first end 302A, second sealing mechanism 350B is assembled such that second sealing plug 313B is extended into and secured in a fluid-impermeable manner against cap central hole 315 and second feedthrough plug 316B is extended into and secured in a fluid-impermeable manner against second feedthrough hole 306B. In addition, sealing cap 321B is extended into and secured in a fluid-impermeable manner against bore-defining surface 301A. Therefore, second sealing mechanism 350B provides an impermeable sealing on second end 302B of drill rod body 301.

Second sealing mechanism 350B as described herein may also be applied to and/or used in any of the detector drill rods (e.g. detector drill rods 100, 200A-C and 400) disclosed herein.

Detector drill rod 300 may be deployed in a drill string. First, muon detector assembly 305 may be securely attached to conduit 304. Then, the combined conduit 304 with muon detector assembly 305 may be inserted into drill rod bore 303. Conduit 304 may then be connected to first seal 321A by first sealing mechanism 350A to provide a fluid-impermeable connection at first longitudinal end 302A. Second seal 321B may then be inserted into drill rod bore 303 to be connected to conduit 304 by second sealing mechanism 350B to provide a fluid-impermeable connection at second longitudinal end 302B. Then, the assembled detector drill rod 300 may be incorporated into a drill string by connecting to a drill rod at an upstream end of the dill string. After incorporating detector drill rod 300 into the drill string, one or more drill rods may be incorporated into the drill string to further extend the drill string.

Figure 11:
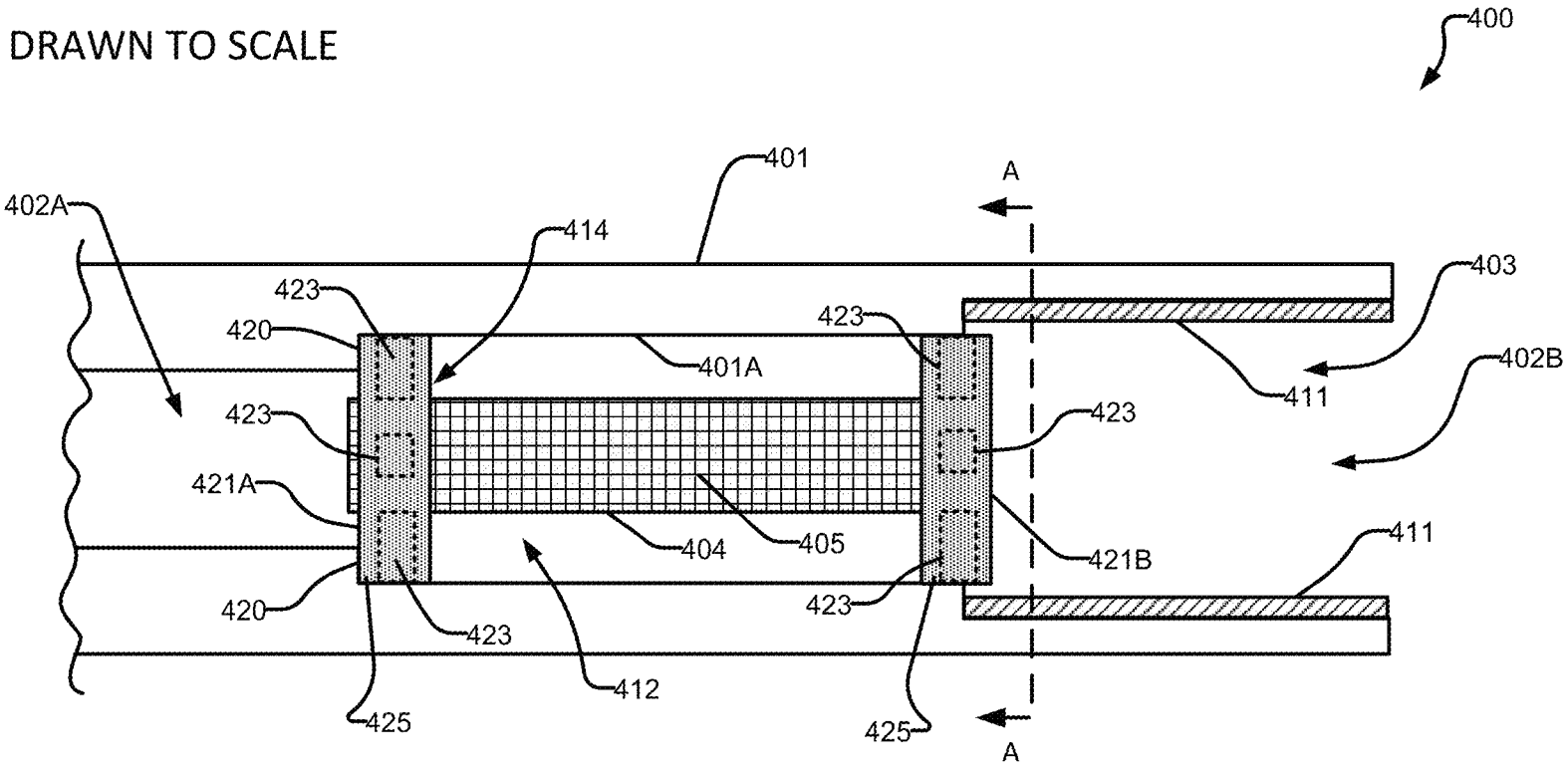
FIG. 11 is a schematic cross-sectional view of a detector drill rod according to another example embodiment.
Figure 12:
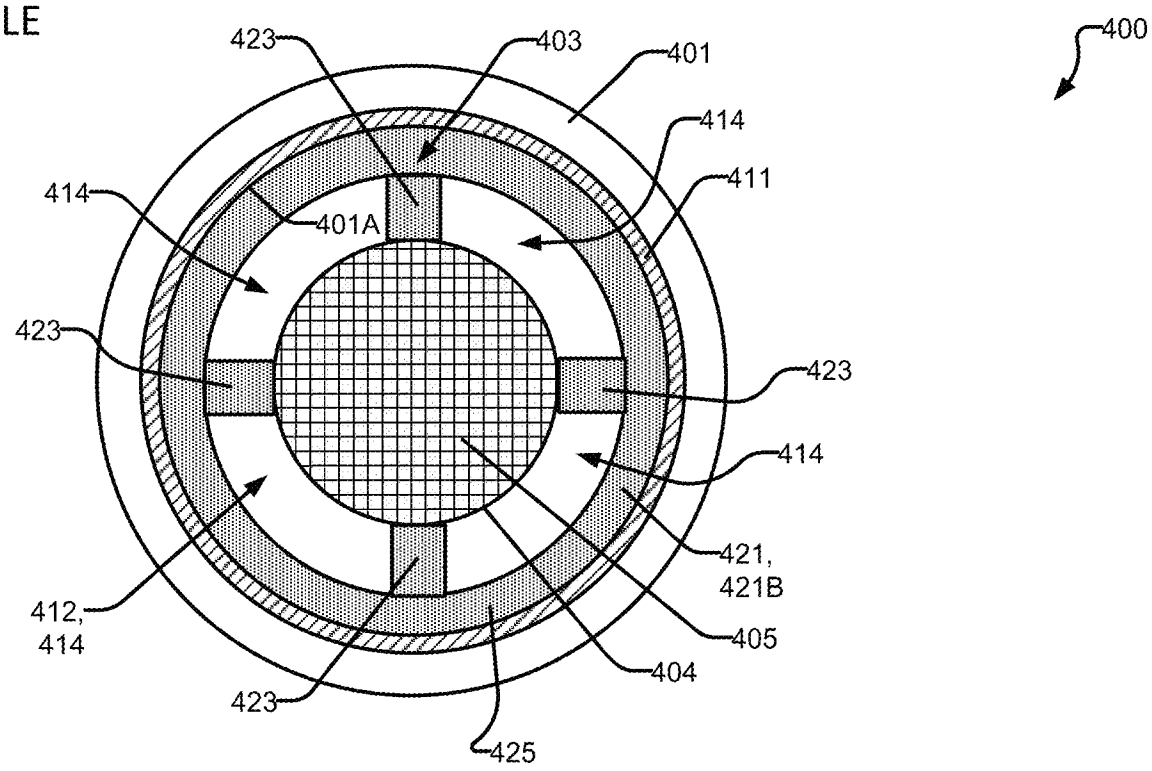
FIG. 12 is a cross-sectional view of the detector drill rod in FIG. 11 along lines A-A.

FIG. 11 is a schematic cross-sectional side view of a detector drill rod 400 according to another example embodiment. FIG. 12 is schematic a cross-sectional view of detector drill rod 400 along lines A-A of FIG. 11.

Referring to FIGS. 11 and 12, detector drill rod 400 comprises a drill rod body 401 comprising a drill rod bore-defining 401A shaped to define a drill rod bore 403. Detector drill rod 400 comprises a muon detector assembly 405 enclosed within a fluid-impermeable housing 404. Housing 404 and muon detector assembly 405 housed there are secured in drill rod bore 403 by one or more apertured brackets 421A, 421B which extend from an exterior surface of housing 404 to contact/engage with drill rod bore-defining surface 401A. Brackets 421A, 421B may be integrally formed with housing 404 or housing 404 may be mounted in brackets 421A, 421B. Apertured brackets 421A, 421B are shaped to define apertures 414 which permit longitudinal fluid flow therethrough. In the illustrated embodiment of FIGS. 11 and 12, apertures brackets 421A, 421B are shaped like spoked wheel rims and comprise a plurality of radially extending spoke portions 423 and a rim portion 425 with an annular cross-section for supporting fluid-impermeable housing 404 and muon detector assembly 405 housed therein in drill rod bore 403. Apertures 414 defined by apertured brackets 421A, 421B define fluid flow passageway 412 longitudinally through drill rod bore 403.

In the illustrated embodiment, detector drill rod 400 comprises internal female threads 411 at second end 402B configured to engage with threads of an adjacent drill rod (not shown) to be connected to detector drill rod 400. In use, housing 404 (including muon detector assembly 405) is mounted on brackets 421A, 421B (if housing 404 is not integrally formed with brackets 421A, 421B) and then together inserted into drill rod bore 403 from second end 402B and extended longitudinally into drill rod bore 403 towards first end 402A until a longitudinal face of bracket 421A (a longitudinal face of the rim portion 425 of bracket 421A) abuts a longitudinal face of shoulder 420 of drill rod bore-defining surface 401A. Shoulder 420 is a feature of drill rod bore-defining surface 401A where the cross-sectional dimension of drill rod bore 403 changes to thereby provide a longitudinal facing surface. Once bracket 421A abuts against shoulder 402, a male end of an adjacent drill rod is threadably engaged with threads 411 and extended into drill rod bore 403 until it abuts a longitudinal face of bracket 421B, thus securing housing 404 and muon detector assembly 405 within drill rod bore 403 and simultaneously connecting the adjacent drill rod to detector drill rod 400. In some embodiments, bracket 421B is shaped to define a spacer portion or reduced cross-section extending longitudinally into connector 411 such that the male end of an adjacent drill rod abuts the spacer portion of the bracket 421B to secure muon detector assembly 405 in drill rod bore 403. In some embodiments, additional (e.g. more than two) apertured brackets 421 may be provided. In some embodiments, a single apertured bracket 421 may be provided. For example, such a single aperture bracket may have a longitudinal dimension that is greater than that of brackets 421A, 421B shown in FIGS. 11, 12 to provide greater stability and to help secure muon detector assembly 405 in drill rod bore 403. For example, such a single bracket could extend the entire longitudinal dimension between brackets 421A, 421B shown in FIG. 11.

The fluid-impermeable housing 404 and apertured brackets 421 as described herein may also be applied to and/or used in any of the detector drill rods (e.g. detector drill rods 100, 200A-C and 300) disclosed herein.

Deployment of Detector Drill Rod

Figure 2:
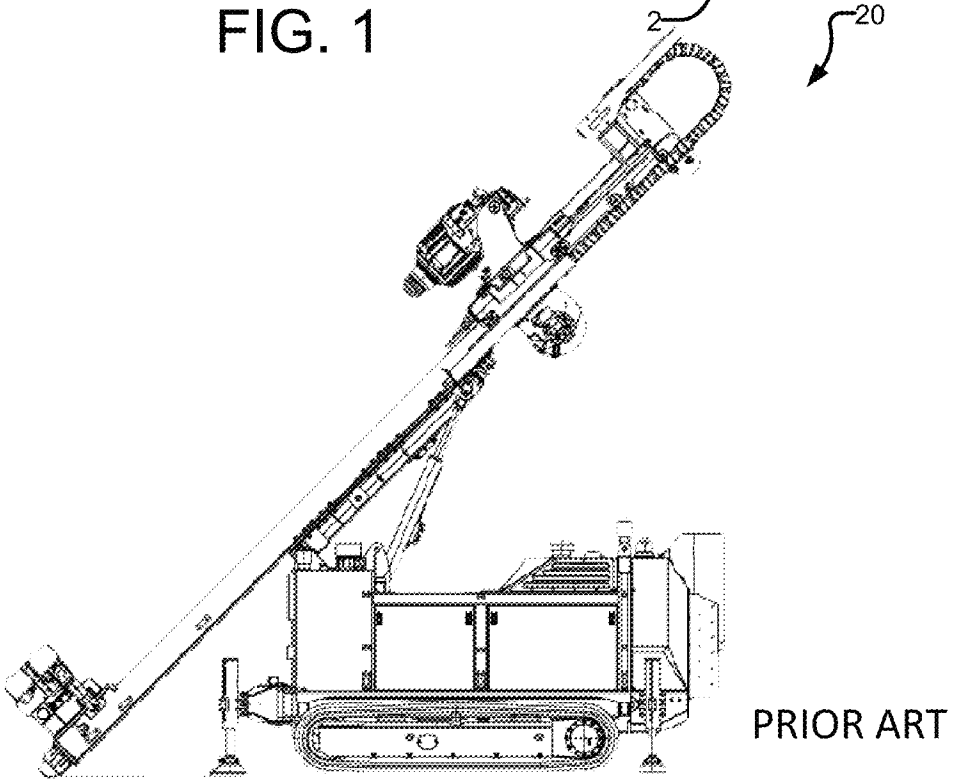
FIG. 2 is a schematic side view of a conventional prior art drill rig.

Detector drill rods (e.g. drill rods 100-400) as disclosed herein may be deployed by a conventional drill rig 20. Drill rig 20 shown in FIG. 2 represents one non-limiting example of a drill rig. It will be appreciated that other drill rigs can be used to deploy the detector drill rods of the various embodiments disclosed herein.

In an example embodiment, drill rig 20 is operated in a conventional manner by standard practice to drill a borehole in the earth. In some embodiments, a conventional drill string without detector drill rods is used to complete the initial drilling of a borehole. Once a borehole has been drilled using standard practice, the drill string and drill rods for drilling the borehole can be extracted from the borehole (also in the conventional manner).

Once the drill string for drilling the borehole is extracted, a drill string can then be re-inserted into the borehole by re-inserting individual drill rods one at a time, for example, by threadably securing successive drill rods to one another (at the surface) as the drill string is re-inserted into the borehole.

In an example embodiment, one or more detector drill rods as disclosed herein can be inserted or otherwise incorporated into the re-inserted drill string at desired locations. As described above, the detector drill rod(s) can comprise a suitable muon detector assembly for detecting cosmic ray muons. Advantageously, because the detector drill rod(s) form part of the drill string and provide for longitudinal fluid (e.g. drilling fluid and/or rock cuttings) passage therethrough, the drill string with the one or more detector drill rods can be used to drill out partial or full blockages of the previously drilled borehole (e.g. due to debris, drill rod fluid, collapse of the borehole and/or other contaminants) to facilitate deployment of the detector drill rod(s) are desired downhole locations.

In some embodiments, a single re-inserted drill string at a single narrow aperture borehole can comprise one or more detector drill rods, each detector drill rod having an associated muon detector assembly therein. In some embodiments, multiple boreholes can be drilled in a vicinity of desired subsurface formation, wherein one or more detector rods can be incorporated into the drill string at each borehole.

FIGS. 13A-H show various sequential steps to be performed to a drill string 500 in a method for deploying a detector drill rod downhole according to an example embodiment. Specifically, FIGS. 13A-H show a method for electrically connecting a detector drill rod to suitable surface equipment (not shown) for receiving power at the downhole detector drill rod and/or for communications between the detector drill rod and the surface equipment.

Figure 13A:
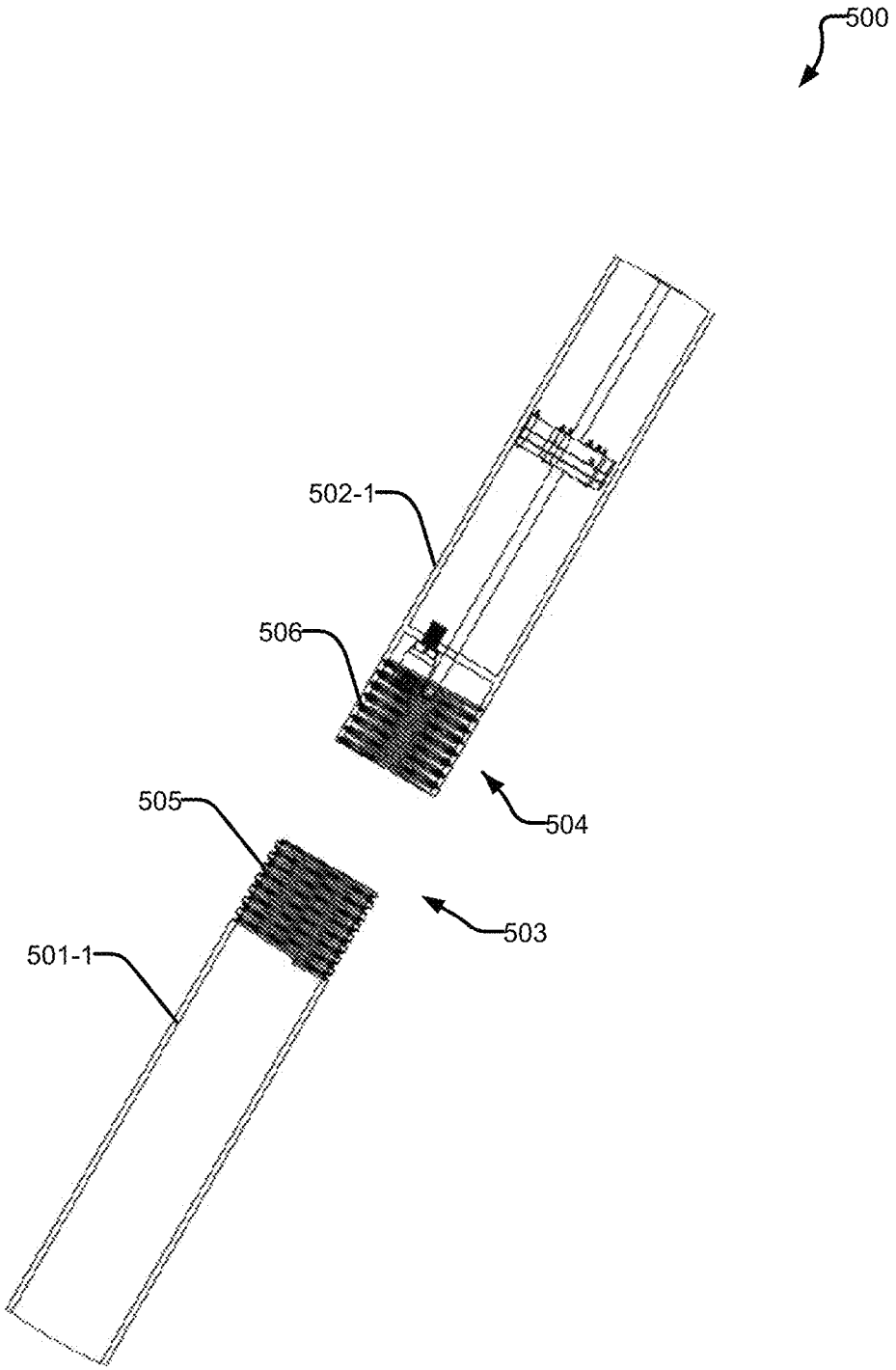
FIGS. 13A-H are side views of sequential steps in the deployment of detector drill rods in a drill string into a borehole.

FIG. 13A shows a detector drill rod 502-1 being inserted into drill string 500 as drill string 500 is being threaded one rod at a time. In FIG. 11A, a downhole end 404 of detector drill rod 502-1 is being threadably connected to an uphill end 403 of a conventional drill rod 501-1 via engagement of downhole thread 506 of detector drill rod 502-1 with uphole thread 505 of conventional drill rod 501-1.

Figure 13B:
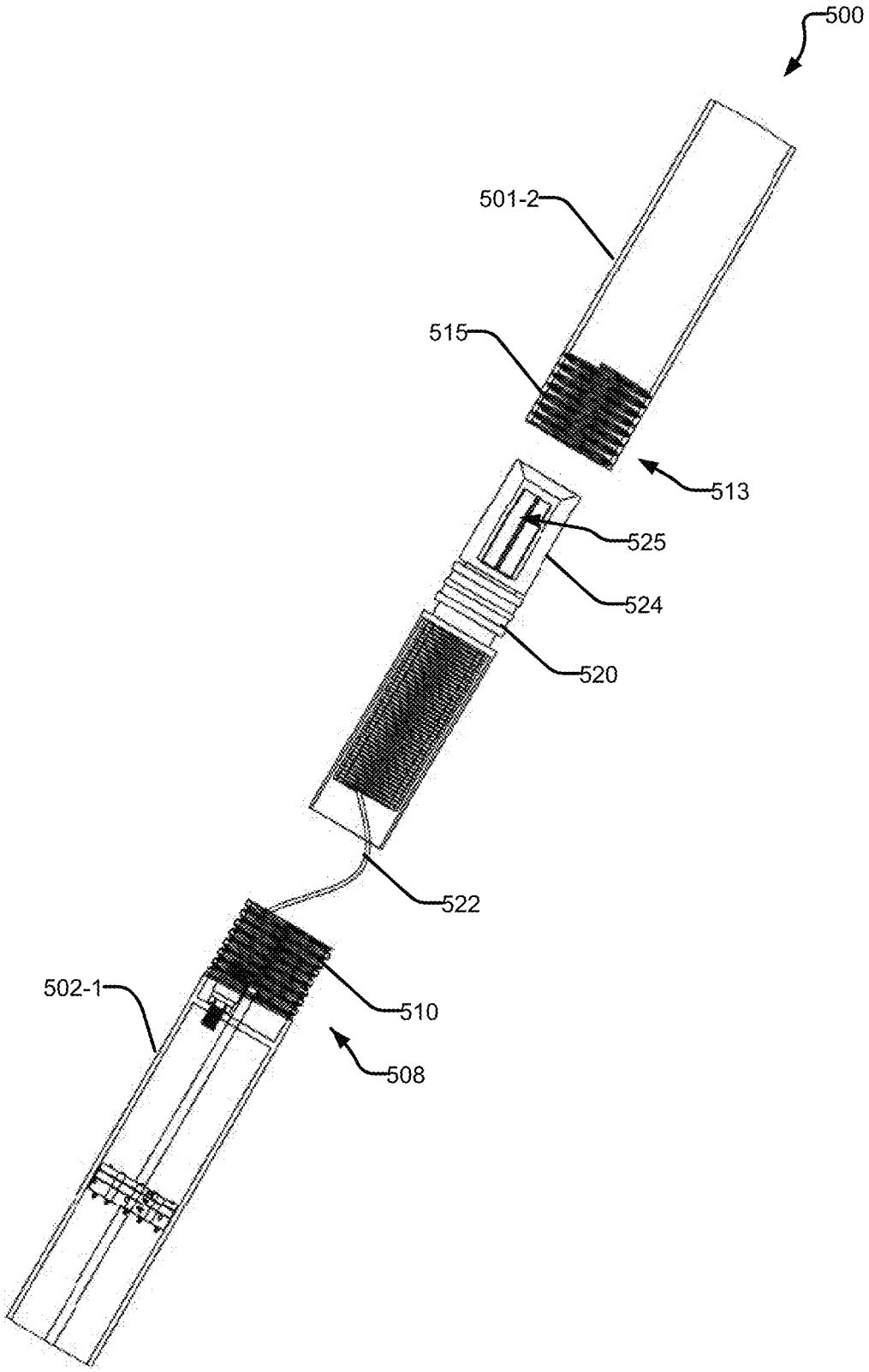

FIG. 13B shows detector drill rod 502-1 being connected to cable(s) 522 of a cable barrel 520. Although not expressly shown in FIG. 13B, it will be understood that the connection of cable(s) 422 to detector drill rod 402-1 may provide power and/or communications to the muon detector assembly housed in detector drill rod 402-1. After connection of cable(s) 422 and cable barrel 420 uphole end 508 of detector drill rod 502-1 is threadably connected to downhole end 513 of another conventional drill rod 501-2 via threaded engagement between threads 510 of detector drill rod 502-1 and threads 515 of conventional drill rod 501-2. Cable barrel 520 comprises a pre-spooled length of cable(s) 522 which is disposed on cable barrel 520. Cable(s) 522 can be connected to feedthrough plugs of detector drill rod 502-1 (e.g. feedthrough plugs 316) as described above in relation to FIGS. 8A and 8B or otherwise connected to detector drill rod 502-1 to provide power and/or communications to the muon detector assembly housed in detector drill rod 502-1. Cable barrel 520 of the illustrated embodiment comprises a tail 524 which comprises a connector 525.

Figure 13C:
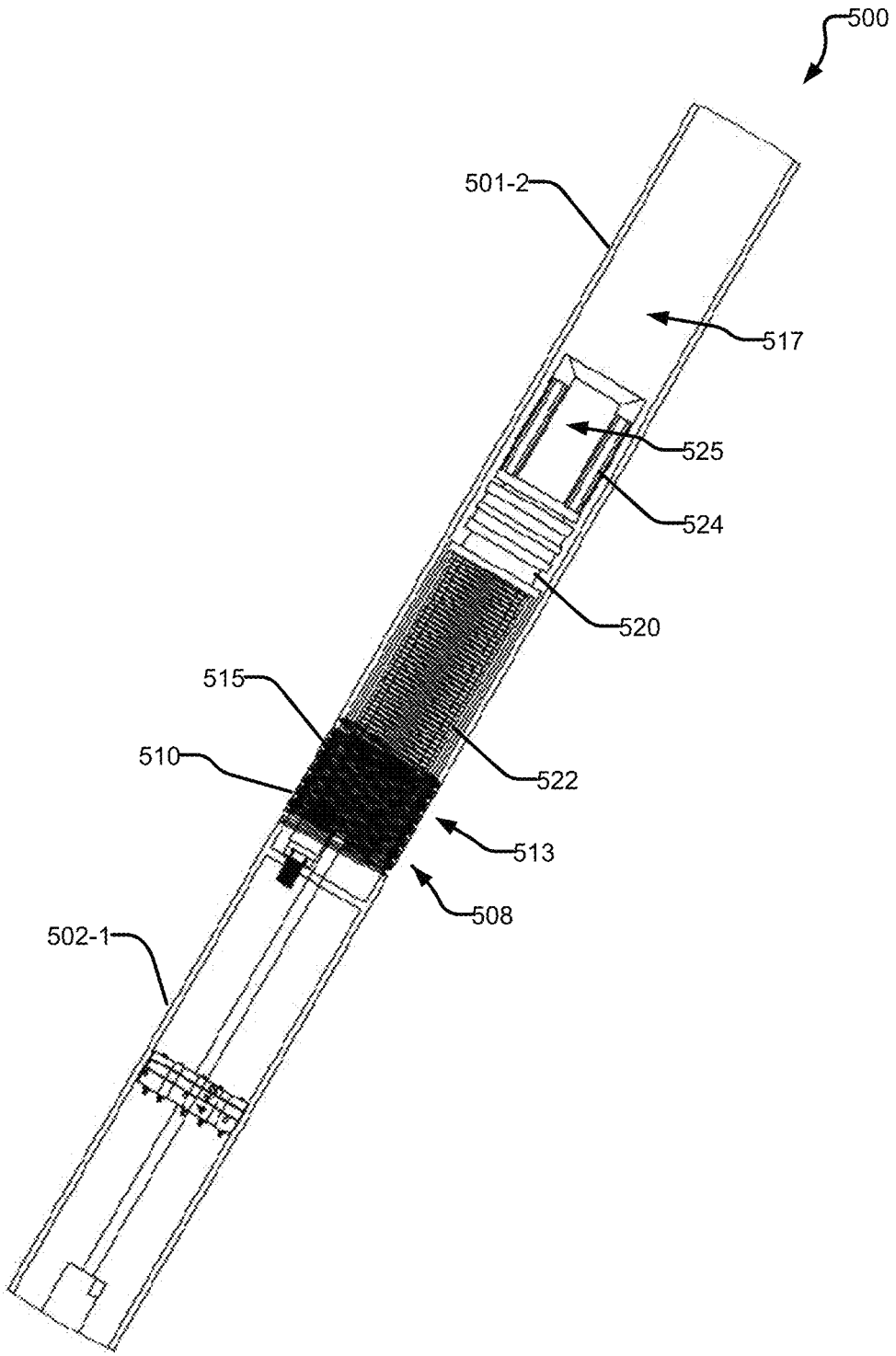

FIG. 13C shows detector drill rod 502-1 and conventional drill rod 501-2 in a connected state. Cable barrel 520 is located within a bore 417 of conventional drill rod 501-2.

Figure 13D:
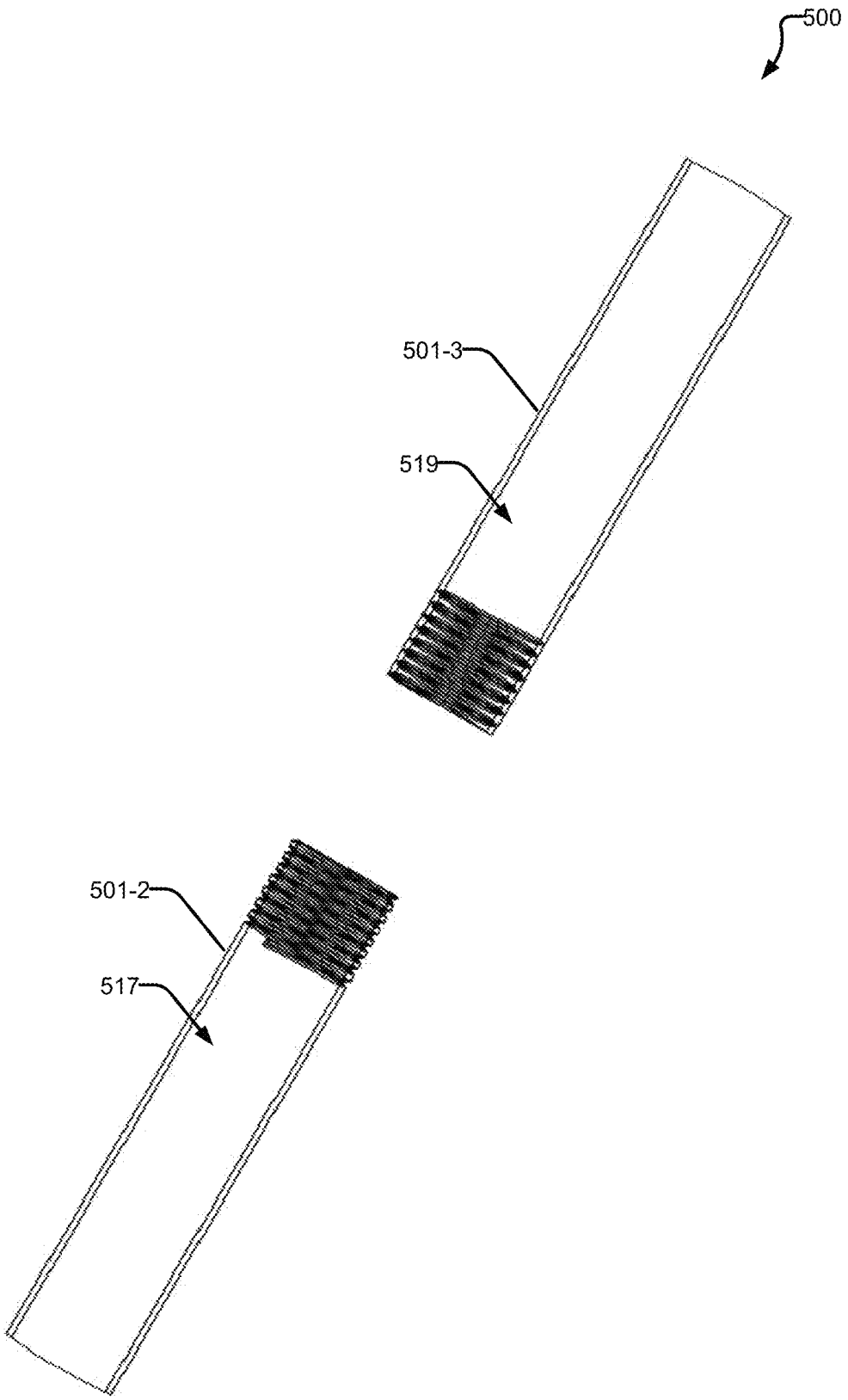

FIG. 13D shows conventional drill rod 501-2 being threadably connected to another conventional drill rod 501-3 for further extending drill string 500 down the borehole. Conventional drill rod 501-3, similar to conventional drill rod 501-2, is shaped to define a bore 519 that is of similar dimension to bore 417 of conventional drill rod 501-2 such that cable barrel 520 can fit within bore 519. The step shown in FIG. 11D may be repeated until a desired number of conventional drill rods is added to drill string 500.

Figure 13E:
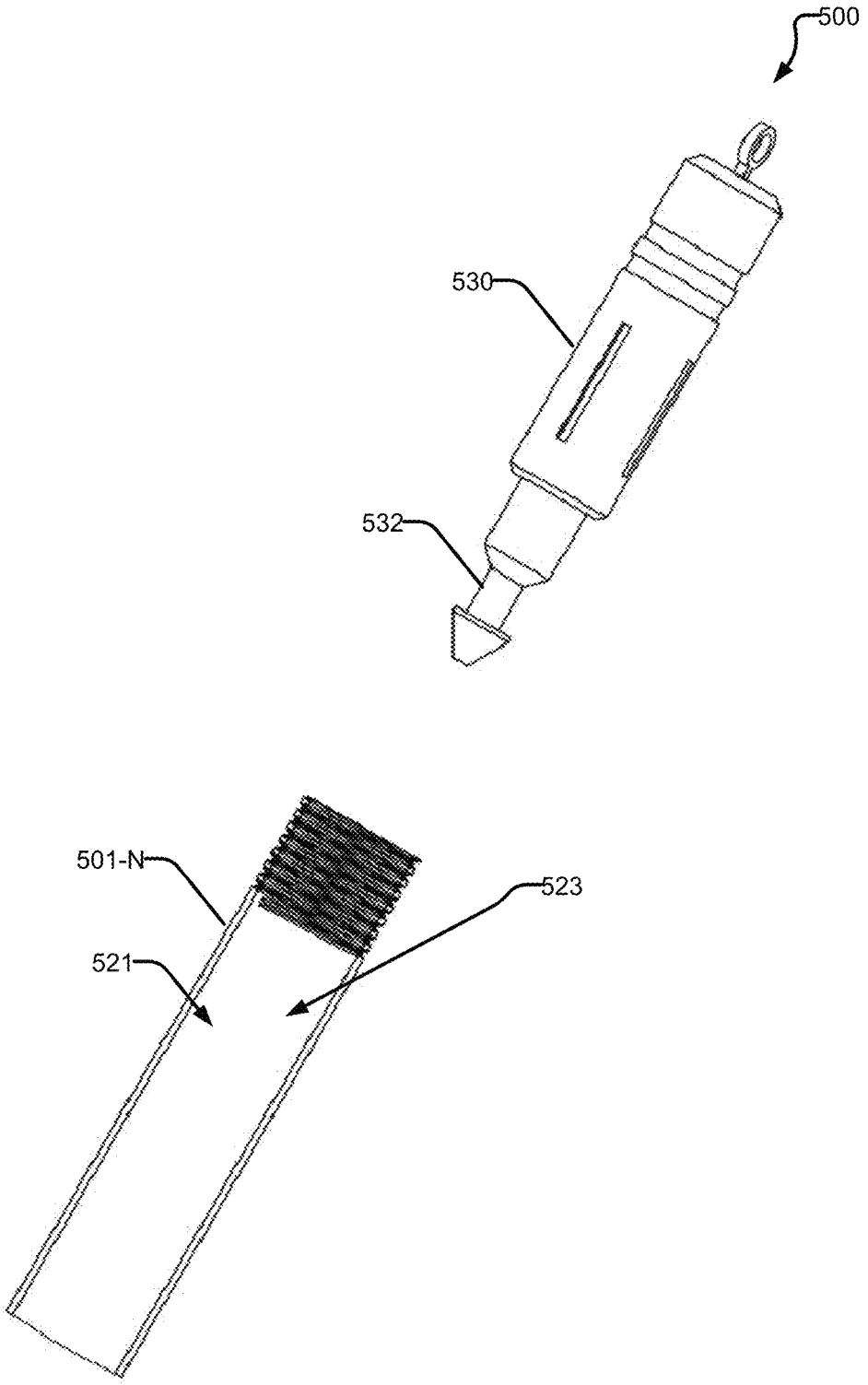

FIG. 13E shows an overshot tool 530 that can be inserted into bore 521 of conventional drill rod 521-N in drill string 500. In operation, overshot tool 530 is connected by, for example, cable to a retrieval unit (not shown) above the surface of the earth such that overshot tool 530 can be lowered or driven into the bore 523 of drill string 500 and also retrieved through the bore 523 of drill string 500. Overshot tool 530 comprises a connector 532 at its downhole end that is complementary to connector 525 of cable barrel 520.

Figure 13F:
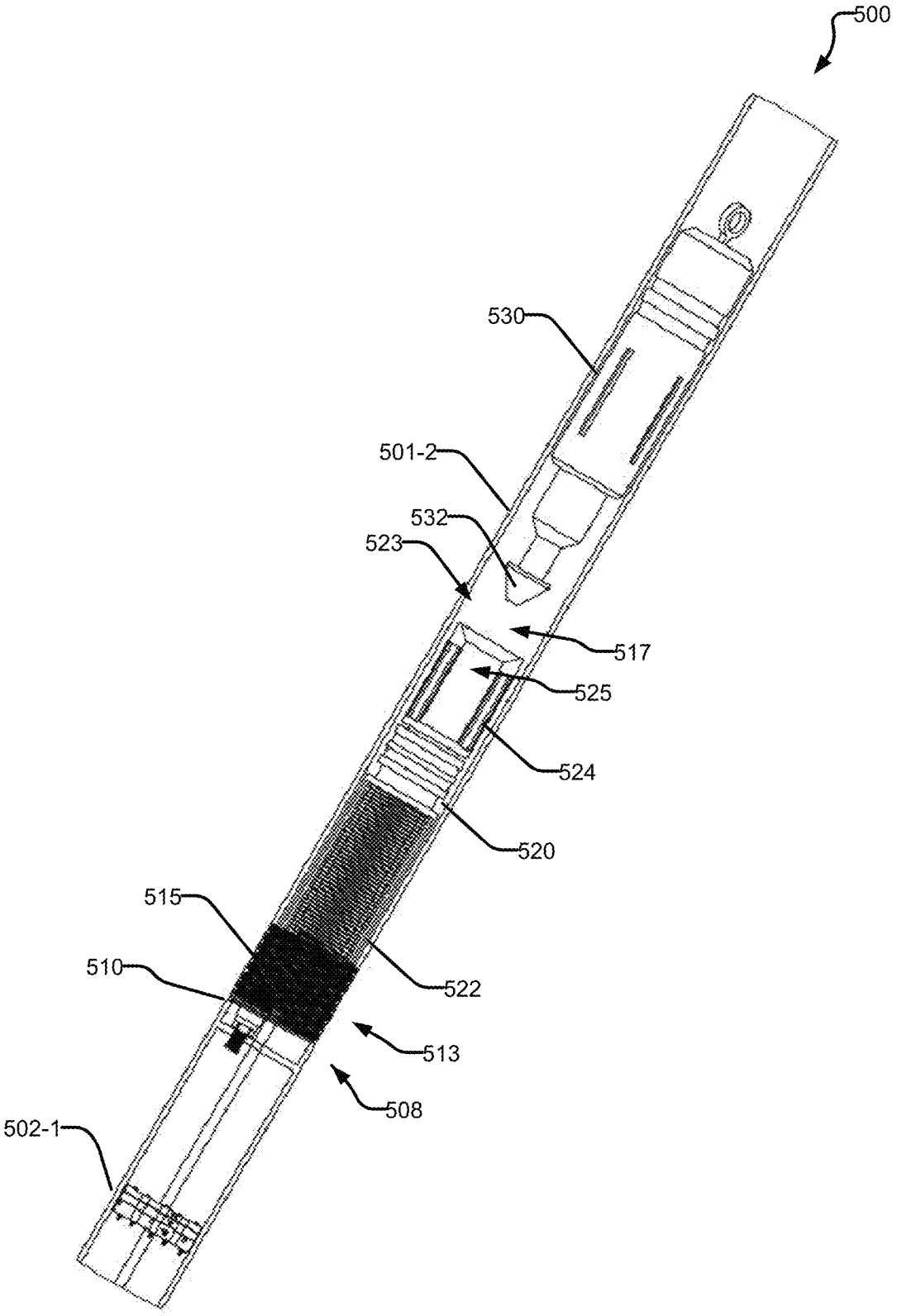

FIG. 13F shows overshot tool 530 being lowered (or driven) through the bore 523 of drill string 500 until overshot tool 530 reaches bore 417 of conventional drill rod 501-2 (which is connected, at its downhole end, to detector drill rod 502-1). Connector 532 of overshot tool 530 engages with connector 525 of tail 524 of cable barrel 520. Connector 425, 532 may comprise any suitable mechanism for securing overshot tool 530 to cable barrel 520. For example, tail 524 may comprise a one-way gate that allows connector 532 to push into connector 525 which in turn clamps down and pinches connector 532 when connector 532 is in connector 525 thus preventing connector 532 from separating from connector 525 when uphole oriented force is applied to overshot tool 430.

Figure 13G:
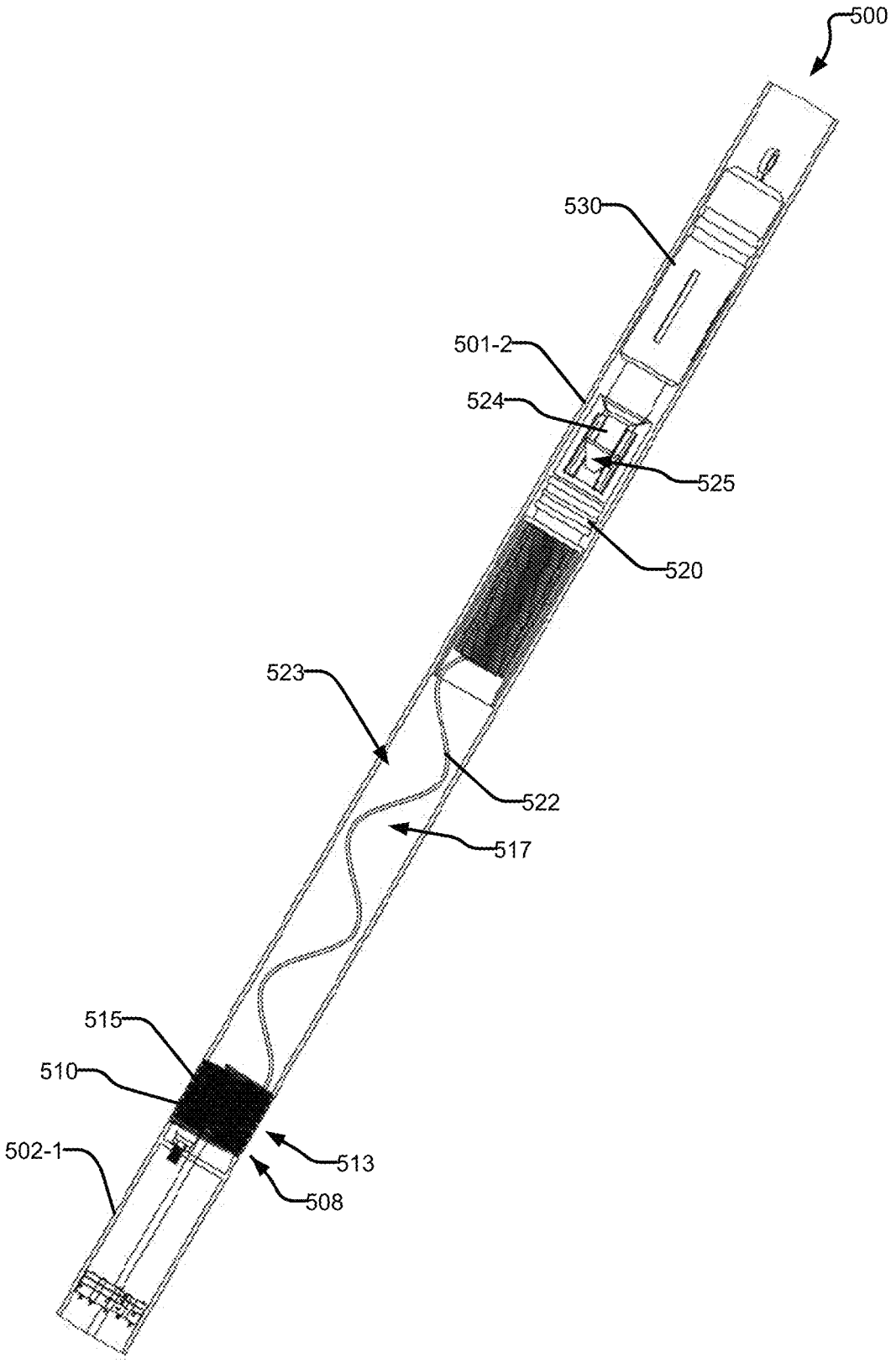

FIG. 13G shows overshot tool 530 connected to cable barrel 520 via engagement of arrowhead 532 with hole 525 and pre-spooled cable 522 being unwound and released from cable barrel 520 as overshot tool 530 pulls cable barrel 520 uphole towards the surface of the earth through the bore of drill string 500 when overshot tool 530 is being retrieved by the retrieval unit (not shown). Unwound cable 522 retrieved by overshot tool 530 can be connected directly to surface equipment, such as power equipment, communications equipment, data storage, computer processors and/or the like. Unwound cable 522 retrieved by overshot tool 530 can be additionally or alternatively connected to another detector drill rod.

Figure 13H:
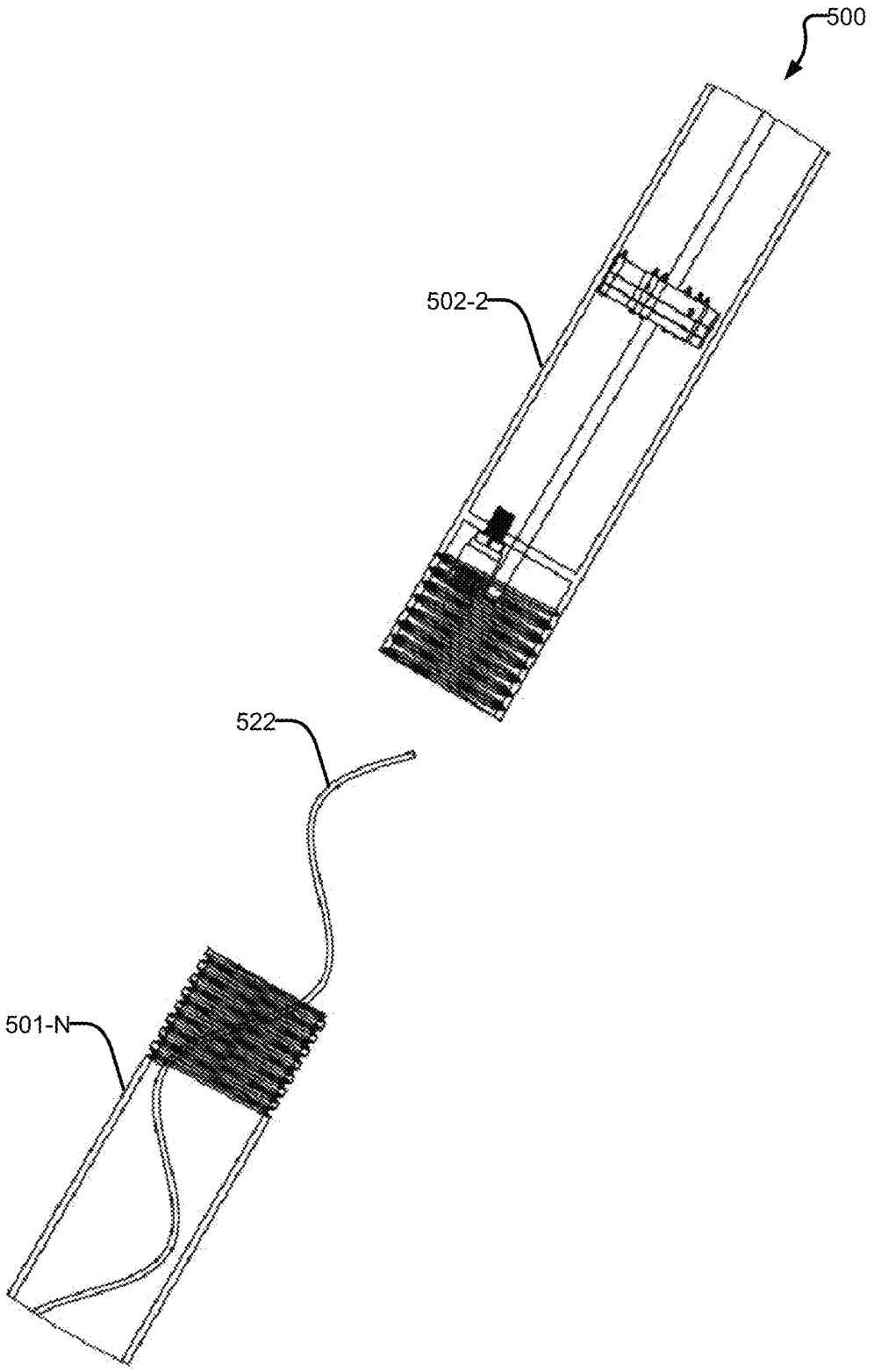

FIG. 13H shows cables 522 being retrieved past conventional drill rod 501-N and being connected to another detector drill rod 502-2. Detector drill rod 502-2 may then be incorporated into drill string 500 and be connected to surface equipment or another detector drill rod upstream of detector drill rod 502-2 by application of the same overshot tool method as described above. The disclosed embodiment of deployment of detector drill rods allows for any desired number of detector drill rods to be deployed downhole into a borehole through a drill string.

After cabling and communications are operatively connected with the surface equipment, the cosmic ray detectors can proceed with their operation and the surface equipment can produce a subsurface density map of the desired subsurface formation.

In some embodiments, the overshoot tool method shown in FIGS. 13A-H is not necessary. In some embodiments, cables can be connected to a detector drill rod when the detector drill rod is at the surface and then threaded through the bore of each successive drill rod added to the drill string at the surface as each drill rod is added to the string. In some embodiments, cables are not required as power can be provided to detector drill rod using a battery housed in the bore of the detector drill rod and wireless communications technology (e.g. mud pulse telemetry) can be used for communication between the downhole detector drill rod and surface communications equipment.

The invention comprises a number of non-limiting aspects. Non-limiting aspects of the invention comprise:

1. A longitudinally extending detector drill rod connectable at each of its longitudinal ends to another drill rod in a drill string and deployable, as part of the drill string, to a location below a surface of the earth for detecting cosmic ray muons that penetrate the surface of the earth, the detector drill rod comprising:
   - a drill rod bore-defining surface that defines a longitudinally extending drill rod bore; and,
   - one or more muon sensors located in the drill rod bore, the one or more muon sensors responsive to muons interacting therewith.

2. The detector drill rod according to aspect 1 or any other aspect herein comprising a fluid flow passage located in the drill rod bore for permitting fluid flow from a first longitudinal end of the drill rod bore to a second longitudinal end of the drill rod bore, the second longitudinal end opposed to the first longitudinal end.
3. The detector drill rod according to aspect 2 or any other aspect herein wherein the one or more muon sensors are located outside of the fluid flow passage.
4. The detector drill rod according to any one of claims 2 to 3 or any other aspect herein wherein the fluid flow passages comprises a longitudinally extending conduit, the conduit comprising a conduit bore-defining surface that defines a longitudinally extending conduit bore for permitting fluid flow therethrough.
5. The detector drill rod according to aspect 4 or any other aspect herein wherein the conduit is centrally located in the drill rod bore in cross-sections having sectional planes orthogonal to a longitudinal direction (e.g. the conduit is symmetric about a longitudinally extending central axis of the drill rod bore).
6. The detector drill rod according to any one of aspects 4 to 5 or any other aspect herein wherein the one or more muon sensors are mounted to the conduit and located on an exterior of the conduit.
7. The detector drill rod according to any one of aspects 4 to 6 or any other aspect herein comprising:
   a first seal located relatively close to the first longitudinal end of the drill rod bore, the first seal sealed to, or integrally formed with, the drill rod bore defining surface and the first seal sealed to, or integrally formed with, the conduit;
   a second seal located relatively close to the second end of the drill rod bore, the second seal sealed to the drill rod bore defining surface and the second seal sealed to, or integrally formed with, the conduit;
   the seals and/or integral formation of the first and second seals providing a fluid-impermeable region that is in the drill rod bore, between longitudinal locations of the first and second seals and exterior to the conduit, the one or more muon sensors located in the fluid-impermeable region while permitting fluid flow through the conduit bore between a longitudinal side of the second seal opposite the first seal location and a longitudinal side of the first seal opposite the second seal location.
8. The detector drill rod according to aspect 7 or any other aspect herein wherein the first seal is welded to the drill rod bore-defining surface.
9. The detector drill rod according to aspect 7 or any other aspect herein wherein the first seal is sealed to the drill rod bore-defining surface by one or more ring seals disposed between the first seal and the drill rod-bore defining surface.
10. The detector drill rod according to aspect 9 wherein the one or more ring seals are disposed around a circumferential facing surface of the first seal.
11. The detector drill rod according to aspect 9 wherein the one or more ring seals are disposed between a longitudinal facing surface of the first seal and a longitudinal face of a shoulder of the drill rod bore-defining surface, where a cross-sectional dimension of the drill rod bore changes.
12. The detector drill rod according to any one of aspects 7 to 11 or any other aspect herein wherein the first seal comprises a connector component and the conduit comprises a complementary connector component and the first seal is sealed to the conduit by a connection formed between the connector component and the complementary connector component.
13. The detector drill rod according to aspect 12 or any other aspect herein wherein the connector component and the complementary connector component comprise threaded connector components.
14. The detector drill rod according to any one of aspects 9 to 11 or any other aspect herein wherein the first seal is integrally formed with or welded to the conduit.
15. The detector drill rod according to any one of aspects 8 to 11 or any other aspect herein wherein the first seal is shaped to define a hole extending longitudinally therethrough, the first seal is located at the first seal location such a portion of the conduit extends into the hole and wherein the detector drill rod comprises a sealing plug that is insertable into the hole to seal the first seal to the conduit.
16. The detector drill rod according to any one of aspects 7 to 15 or any other aspect herein wherein the second seal is sealed to the drill rod bore-defining surface by one or more ring seals disposed between the second seal and the drill rod-bore defining surface.
17. The detector drill rod according to aspect 16 wherein the one or more ring seals are disposed around a circumferential facing surface of the second seal.
18. The detector drill rod according to aspect 9 wherein the one or more ring seals are disposed between a longitudinal facing surface of the second seal and one of: a longitudinal facing surface of a threaded insert; and a longitudinal facing surface of an adjacent drill rod in the drill string.
19. The detector drill rod according to any one of aspects 7 to 18 or any other aspect herein wherein the second seal comprises a connector component and the conduit comprises a complementary connector component and the second seal is sealed to the conduit by a connection formed between the connector component and the complementary connector component.
20. The detector drill rod according to aspect 19 or any other aspect herein wherein the connector component and the complementary connector component comprise threaded connector components.
21. The detector drill rod according to any one of aspects 7 to 18 or any other aspect herein wherein the second seal is integrally formed with or welded to the conduit.
22. The detector drill rod according to any one of aspects 7 to 18 or any other aspect herein wherein the second seal is shaped to define a hole extending longitudinally therethrough, the second seal is located at the second seal location such a portion of the conduit extends into the hole and wherein the detector drill rod comprises a sealing plug that is insertable into the hole to seal the second seal to the conduit.
23. The detector drill rod according to any one of aspects 7 to 22 or any other aspect herein wherein the second seal is removably sealed to the drill rod bore-defining surface to permit insertion and removal of the second seal from the detector drill rod.
24. The detector drill rod according to any one of aspects 7 to 23 or any other aspect herein wherein the first seal comprises a first feedthrough hole extending longitudinally therethrough and a first feedthrough plug configured to extend into and seal the first feedthrough hole in a fluid impermeable manner while permitting a first electrical connection between a first longitudinal side of the first seal and a second longitudinal side of the first seal opposite the first longitudinal side of the first seal.

25. The detector drill rod according to aspect 24 or any other aspect herein wherein the first electrical connection comprises an extension of one or more electrical cables through the first feedthrough hole.

26. The detector drill rod according to aspect 24 or any other aspect herein wherein the first electrical connection comprises a connection of one more cables to an electrical connector at at least one of the first longitudinal side of the first seal and the second longitudinal side of the first seal.

27. The detector drill rod according to any one of aspects 7 to 26 or any other aspect herein wherein the second seal comprises a feedthrough hole extending longitudinally therethrough and a second feedthrough plug configured to extend into and seal the second feedthrough hole in a fluid impermeable manner while permitting a second electrical connection between a first longitudinal side of the second seal and a second longitudinal side of the second seal opposite the first longitudinal side of the second seal.

28. The detector drill rod according to aspect 27 or any other aspect herein wherein the second electrical connection comprises an extension of one or more electrical cables through the second feedthrough hole.

29. The detector drill rod according to aspect 27 or any other aspect herein wherein the second electrical connection comprises a connection of one more cables to an electrical connector at at least one of the first longitudinal side of the second seal and the second longitudinal side of the second seal.

30. The detector drill rod according to any one of aspects 1 to 3 or any other aspect herein wherein the one or more muon sensors are located in a fluid-impermeable housing, the housing having cross-sectional dimensions (e.g. area) in sectional planes orthogonal to a longitudinal direction that is less than cross-sectional dimensions (e.g. area) of the drill rod bore in the same sectional planes to thereby provide the fluid flow passage between an exterior surface of the housing and the drill rod bore-defining surface.

31. The detector drill rod according to aspect 30 or any other aspect herein comprising a support bracket extending from the exterior surface of the housing to the drill rod bore-defining surface for supporting the housing, the support bracket shaped to define one or more longitudinal apertures therethrough to provide the fluid flow passage between a first longitudinal side of the support bracket and a second longitudinal side of the support bracket opposite to the first longitudinal side of the support bracket.

32. The detector drill rod according to aspect 31 or any other aspect herein comprising a second support bracket extending from the exterior surface of the housing to the drill rod bore-defining surface for supporting the housing, the second support bracket spaced longitudinally apart from the support bracket, the second support bracket shaped to define one or more second longitudinal apertures therethrough to provide the fluid flow passage between a first longitudinal side of the second support bracket and a second longitudinal side of the second support bracket opposite to the first longitudinal side of the second support bracket.

33. The detector drill rod according to any one of aspects 31 to 32 or any other aspect herein wherein the support bracket abuts against a longitudinal face of a shoulder of the drill rod bore-defining surface, where a cross-sectional dimension of the drill rod bore changes.

34. The detector drill rod according to aspect 32 or any other aspect herein wherein:

the support bracket abuts against a longitudinal face of a shoulder of the drill rod bore-defining surface, where a cross-sectional dimension of the drill rod bore changes; and the second support bracket abuts against at least one of: a longitudinal facing surface of a threaded insert; and a longitudinal facing surface of an adjacent drill rod in the drill string.

35. A method for detecting cosmic ray muons that penetrate a surface or the earth, the method comprising:

(i) locating one or more muon sensors in a drill rod bore of a detector drill rod;

(ii) connecting the detector drill rod to one or more other drill rods to provide a drill string;

(iii) inserting at least a portion of the drill string including the detector drill rod below the surface of the earth.

36. The method according to aspect 35 or any other aspect herein comprising, prior to performing steps (ii) and (iii):

drilling a borehole with a second drill string that does not include the detector drill rod;

extracting at least a portion of the second drill string from the borehole.

37. The method according to aspect 36 or any other aspect herein wherein inserting at least a portion of the drill string including the detector drill rod below the surface of the earth comprises drilling through the earth in the borehole with the drill string that includes the detector drill rod.

38. The method according to aspect 35 or any other aspect herein wherein inserting at least a portion of the drill string including the detector drill rod below the surface of the earth comprises drilling through the earth with the drill string that includes the detector drill rod.

39. The method according to any one of aspects 35 to 38 or any other aspect herein comprising inserting a cable barrel into a bore of the drill string, the cable barrel comprising pre-spooled cable wherein the pre-spooled cable of the cable barrel is connected to the detector drill rod prior to step (iii).

40. The method according to aspect 39 or any other aspect herein comprising inserting an overshot tool into the bore of the drill string after step (iii), the overshot tool connectable to the cable barrel.

41. The method according to aspect 4 or any other aspect herein comprising connecting the overshot tool to the cable barrel when the cable barrel is located downhole and retrieving the cable barrel through the bore of the drill string by pulling the overshot tool in an uphole direction.

42. The method according to aspect 41 or any other aspect herein wherein pulling the overshot tool in the uphole direction comprises un-spooling the pre-spooled cable from the cable barrel.

43. The method according to any one of aspects 35 to 42 or any other aspect herein wherein locating one or more muon sensors in the drill rod bore of the detector drill rod comprises: inserting a muon detector assembly comprising the one or more muon sensors into the drill rod bore through one of first and second longitudinally opposed ends of the detector drill rod; and securing a longitudinal location of the muon detector assembly in the drill rod bore with one or more securing components inserted into the drill rod bore through the one of the first and second ends of the detector drill rod.

44. The method according to aspect 43 or any other aspect herein wherein the securing components comprise one of more of: a seal; a threaded insert; and a longitudinal facing surface of an adjacent drill rod in the drill string.

45. The method according to any one of aspects 43 to 44 or any other aspect herein wherein inserting a muon detector assembly comprising the one or more muon sensors into the drill rod bore through the one of first and second longitudinally opposed ends of the detector drill rod comprises: mounting the detector assembly on a conduit; and inserting the conduit into the drill rod bore through the one of the first and second ends.

46. The method of aspect 45 or any other aspect herein wherein the conduit is shaped to define a conduit bore which provides at least a portion of a fluid flow passage for permitting fluid flow between the first and second ends.

47. The method of any one of aspects 43 to 44 or any other aspect herein wherein inserting a muon detector assembly comprising the one or more muon sensors into the drill rod bore through the one of first and second longitudinally opposed ends of the detector drill rod comprises: housing the one or more muon sensors in a fluid-impermeable housing; providing one or more apertured brackets integrally formed with or rigidly connected to an exterior of the housing; and inserting a combination of the housing and the one or more brackets into the drill rod bore through the one of the first and second ends.

48. The method of aspect 47 or any other aspect herein wherein the one or more apertured brackets are shaped to provide one or more apertures which provide at least a portion of a fluid flow passage for permitting fluid flow between the first and second ends.

49. The method of any one of aspects 43 to 44 or any other aspect herein wherein securing the longitudinal location of the muon detector assembly in the drill rod bore comprises making use of any of the features, combinations of features and/or sub-combinations of features of any of aspects 1-34 or any of the features, combinations of features and/or sub-combinations of features otherwise described herein.

50. The method according to any one of aspects 35 to 45 or any other aspect herein wherein locating one or more muon sensors in the drill rod bore of the detector drill rod comprises providing fluid flow passage between the first and second ends.

51. The method according to aspect 50 or any other aspect herein wherein locating one or more muon sensors in the drill rod bore of the detector drill rod comprises locating the one or more muon sensors outside of the fluid flow passage.

52. The method according to any one of aspects 50 to 51 or any other aspect herein wherein locating the one or more muon sensors outside of the fluid flow passage comprises sealing the fluid flow passage from a region of the drill rod bore where the one or more muon sensors are located.

53. The method of aspect 52 or any other aspect herein wherein sealing the fluid flow passage from a region of the drill rod bore where the one or more muon sensors are located comprises making use of any of the features, combinations of features and/or sub-combinations of features of any of aspects 1-34 or any of the features, combinations of features and/or sub-combinations of features otherwise described herein.

54. A method for assembling a longitudinally extending detector drill rod for deployment in a drill string to a location below a surface of the earth for detecting cosmic ray muons that penetrate the surface of the earth, the method comprising:

(i) providing a longitudinally extending detector drill rod having first and second longitudinally spaced apart ends, the detector drill rod comprising a drill rod bore-defining surface that defines a longitudinally extending drill rod bore;

(ii) inserting a muon detector assembly comprising one or more muon sensors into the drill rod bore through one of the first and second ends of the detector drill rod;

(iii) securing a longitudinal location of the muon detector assembly in the drill rod bore with one or more securing components inserted into the drill rod bore through the one of the first and second ends of the detector drill rod.

55. The method of aspect 54 or any other aspect herein wherein the securing components comprise one of more of: a seal; a threaded insert; and a longitudinal facing surface of an adjacent drill rod in the drill string.

56. The method of any one of aspects 54 to 55 or any other aspect herein wherein inserting the muon detector assembly into the drill rod bore through the one of the first and second ends comprises: mounting the detector assembly on a conduit; and inserting the conduit into the drill rod bore through the one of the first and second ends.

57. The method of aspect 56 or any other aspect herein wherein the conduit is shaped to define a conduit bore which provides at least a portion of a fluid flow passage for permitting fluid flow between the first and second ends.

58. The method of any one of aspects 54 to 55 or any other aspect herein wherein inserting the muon detector assembly into the drill rod bore through the one of the first and second ends comprises: housing the one or more muon sensors in a fluid-impermeable housing; providing one or more apertured brackets integrally formed with or rigidly connected to an exterior of the housing; and inserting a combination of the housing and the one or more brackets into the drill rod bore through the one of the first and second ends.

59. The method of aspect 58 or any other aspect herein wherein the one or more apertured brackets are shaped to provide one or more apertures which provide at least a portion of a fluid flow passage for permitting fluid flow between the first and second ends.

60. The method of any one of aspects 54 to 59 or any other aspect herein wherein securing the longitudinal location of the muon detector assembly in the drill rod bore comprises making use of any of the features, combinations of features and/or sub-combinations of features of any of aspects 1-34 or any of the features, combinations of features and/or sub-combinations of features otherwise described herein.

61. The method according to any one of aspects 54 to 60 or any other aspect herein wherein inserting the muon detector assembly into the drill rod bore through the one of the first and second ends comprises providing fluid flow passage between the first and second ends.

62. The method according to aspect 60 or any other aspect herein wherein inserting the muon detector assembly into the drill rod bore through the one of the first and second ends comprises locating the one or more muon sensors outside of the fluid flow passage.
63. The method according to any one of aspects 61 to 62 or any other aspect herein wherein locating the one or more muon sensors outside of the fluid flow passage comprises sealing the fluid flow passage from a region of the drill rod bore where the one or more muon sensors are located.
64. The method of aspect 63 or any other aspect herein wherein sealing the fluid flow passage from a region of the drill rod bore where the one or more muon sensors are located comprises making use of any of the features, combinations of features and/or sub-combinations of features of any of aspects 1-34 or any of the features, combinations of features and/or sub-combinations of features otherwise described herein.
65. Apparatus comprising any features, combination of features and/or sub-combination of features disclosed herein.
66. Method comprising any features, combination of features and/or sub-combination of features disclosed herein Interpretation of Terms Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms. These terms ("a", "an", and "the") mean one or more unless stated otherwise;

"and/or" is used to indicate one or both stated cases may occur, for example A and/or B includes both (A and B) and (A or B);

"approximately" when applied to a numerical value means the numerical value ±10%;

where a feature is described as being "optional" or "optionally" present or described as being present "in some embodiments" it is intended that the present disclosure encompasses embodiments where that feature is present and other embodiments where that feature is not necessarily present and other embodiments where that feature is excluded. Further, where any combination of features is described in this application this statement is intended to serve as antecedent basis for the use of exclusive terminology such as "solely," "only" and the like in relation to the combination of features as well as the use of "negative" limitation(s)" to exclude the presence of other features; and "first" and "second" are used for descriptive purposes and cannot be understood as indicating or implying relative importance or indicating the number of indicated technical features.

Where a range for a value is stated, the stated range includes all sub-ranges of the range. It is intended that the statement of a range supports the value being at an endpoint of the range as well as at any intervening value to the tenth of the unit of the lower limit of the range, as well as any subrange or sets of sub ranges of the range unless the context clearly dictates otherwise or any portion(s) of the stated range is specifically excluded. Where the stated range includes one or both endpoints of the range, ranges excluding either or both of those included endpoints are also included in the invention.

Certain numerical values described herein are preceded by "about". In this context, "about" provides literal support for the exact numerical value that it precedes, the exact numerical value ±5%, as well as all other numerical values that are near to or approximately equal to that numerical value. Unless otherwise indicated a particular numerical value is included in "about" a specifically recited numerical value where the particular numerical value provides the substantial equivalent of the specifically recited numerical value in the context in which the specifically recited numerical value is presented. For example, a statement that something has the numerical value of "about 10" is to be interpreted as: the set of statements:

in some embodiments the numerical value is 10;

in some embodiments the numerical value is in the range of 9.5 to 10.5;

and if from the context the person of ordinary skill in the art would understand that values within a certain range are substantially equivalent to 10 because the values with the range would be understood to provide substantially the same result as the value 10 then "about 10" also includes:

in some embodiments the numerical value is in the range of C to D where C and D are respectively lower and upper endpoints of the range that encompasses all of those values that provide a substantial equivalent to the value 10

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

As will be apparent to those of skill in the art upon reading this disclosure, each of the individual embodiments described and illustrated herein has discrete components and features which may be readily separated from or combined with the features of any other described embodiment(s) without departing from the scope of the present invention.

Any aspects described above in reference to apparatus may also apply to methods and vice versa.

Any recited method can be carried out in the order of events recited or in any other order which is logically possible. For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, simultaneously or at different times.

Various features are described herein as being present in "some embodiments". Such features are not mandatory and may not be present in all embodiments. Embodiments of the invention may include zero, any one or any combination of two or more of such features. All possible combinations of such features are contemplated by this disclosure even where such features are shown in different drawings and/or described in different sections or paragraphs. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible). This is the case even if features A and B are illustrated in different drawings and/or mentioned in different paragraphs, sections or sentences.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A longitudinally extending detector drill rod connectable at each of its longitudinal ends to another drill rod in a drill string and deployable, as part of the drill string, to a location below a surface of the earth for detecting cosmic ray muons that penetrate the surface of the earth, the detector drill rod comprising:

a drill rod bore-defining surface that defines a longitudinally extending drill rod bore; and, one or more muon sensors located in the drill rod bore, the one or more muon sensors responsive to muons interacting therewith.

2. The detector drill rod according to claim 1 comprising a fluid flow passage located in the drill rod bore for permitting fluid flow from a first longitudinal end of the drill rod bore to a second longitudinal end of the drill rod bore, the second longitudinal end opposed to the first longitudinal end.

3. The detector drill rod according to claim 2 wherein the one or more muon sensors are located outside of the fluid flow passage.

4. The detector drill rod according to claim 2 wherein the fluid flow passages comprises a longitudinally extending conduit, the conduit comprising a conduit bore-defining surface that defines a longitudinally extending conduit bore for permitting fluid flow therethrough.

5. The detector drill rod according to claim 4 wherein the conduit is centrally located in the drill rod bore in cross-sections having sectional planes orthogonal to a longitudinal direction (e.g. the conduit is symmetric about a longitudinally extending central axis of the drill rod bore).

6. The detector drill rod according to claim 4 wherein the one or more muon sensors are mounted to the conduit and located on an exterior of the conduit.

7. The detector drill rod according to claim 4 comprising:

first and second seals;

the first seal located relatively close to the first longitudinal end of the drill rod bore when compared to the second seal, the first seal sealed to, or integrally formed with, the drill rod bore defining surface and the first seal sealed to, or integrally formed with, the conduit;

the second seal located relatively close to the second end of the drill rod bore when compared to the first seal, the second seal sealed to the drill rod bore defining surface and the second seal sealed to, or integrally formed with, the conduit;

the seals and/or integral formation of the first and second seals providing a fluid-impermeable region that is in the drill rod bore, between longitudinal locations of the first and second seals and exterior to the conduit, the one or more muon sensors located in the fluid-impermeable region while permitting fluid flow through the conduit bore between a longitudinal side of the second seal opposite the first seal location and a longitudinal side of the first seal opposite the second seal location.

8. The detector drill rod according to claim 7 wherein the first seal is welded to the drill rod bore-defining surface.

9. The detector drill rod according to claim 8 wherein the first seal is shaped to define a hole extending longitudinally therethrough, the first seal is located at the first seal location such that a portion of the conduit extends into the hole and wherein the detector drill rod comprises a sealing plug that is insertable into the hole to seal the first seal to the conduit.

10. The detector drill rod according to claim 7 wherein the first seal is sealed to the drill rod bore-defining surface by one or more ring seals disposed between the first seal and the drill rod-bore defining surface.

11. The detector drill rod according to claim 10 wherein the one or more ring seals are disposed around a circumferential facing surface of the first seal.

12. The detector drill rod according to claim 10 wherein the one or more ring seals are disposed between a longitudinal facing surface of the first seal and a longitudinal face of a shoulder of the drill rod bore-defining surface, where a cross-sectional dimension of the drill rod bore changes.

13. The detector drill rod according to claim 10 wherein the first seal is integrally formed with or welded to the conduit.

14. The detector drill rod according to claim 10 wherein the one or more ring seals are disposed between a longitudinal facing surface of the second seal and one of: a longitudinal facing surface of a threaded insert; and a longitudinal facing surface of an adjacent drill rod in the drill string.

15. The detector drill rod according to claim 7 wherein the first seal comprises a connector component and the conduit comprises a complementary connector component and the first seal is sealed to the conduit by a connection formed between the connector component and the complementary connector component.

16. The detector drill rod according to claim 15 wherein the connector component and the complementary connector component comprise threaded connector components.

17. The detector drill rod according to claim 7 wherein the second seal is sealed to the drill rod bore-defining surface by one or more ring seals disposed between the second seal and the drill rod-bore defining surface.

18. The detector drill rod according to claim 17 wherein the one or more ring seals are disposed around a circumferential facing surface of the second seal.

19. The detector drill rod according to claim 7 wherein the second seal comprises a connector component and the conduit comprises a complementary connector component and the second seal is sealed to the conduit by a connection formed between the connector component and the complementary connector component.

20. The detector drill rod according to claim 19 wherein the connector component and the complementary connector component comprise threaded connector components.

* * * * *